US010696369B2

(12) United States Patent
Takase et al.

(10) Patent No.: US 10,696,369 B2
(45) Date of Patent: Jun. 30, 2020

(54) OUTBOARD MOTOR

(71) Applicants: YAMAHA HATSUDOKI KABUSHIKI KAISHA, Iwata-shi, Shizuoka (JP); MARINE CANADA ACQUISITION INC., Richmond (CA)

(72) Inventors: Hiroaki Takase, Shizuoka (JP); Richard Tyler Redfern, Richmond (CA)

(73) Assignees: YAMAHA HATSUDOKI KABUSHIKI KAISHA, Shizuoka (JP); MARINE CANADA ACQUISITION INC., Richmond (CA)

( * ) Notice: Subject to any disclaimer, the term of this patent is extended or adjusted under 35 U.S.C. 154(b) by 0 days.

(21) Appl. No.: 16/409,942

(22) Filed: May 13, 2019

(65) Prior Publication Data

US 2019/0344871 A1 Nov. 14, 2019

(30) Foreign Application Priority Data

May 14, 2018 (JP) ..... 2018-092954

(51) Int. Cl.
*B63H 20/12* (2006.01)
*B63H 20/10* (2006.01)
*B63H 20/06* (2006.01)

(52) U.S. Cl.
CPC ..... *B63H 20/12* (2013.01); *B63H 20/06* (2013.01); *B63H 20/10* (2013.01)

(58) Field of Classification Search
CPC ..... B63H 20/00; B63H 20/06; B63H 20/10; B63H 20/12; B63H 25/00; B63H 25/02; B63H 25/24; B63H 5/125
USPC ..... 440/53, 59, 61 S, 63; 114/144 RE
See application file for complete search history.

(56) References Cited

U.S. PATENT DOCUMENTS

| | | | | |
|---|---|---|---|---|
| 6,276,977 | B1 * | 8/2001 | Treinen | B63H 20/12 440/61 R |
| 7,506,600 | B2 * | 3/2009 | Furuya | B63B 32/56 440/53 |
| 8,246,400 | B2 * | 8/2012 | Ichikawa | B63H 25/20 114/144 RE |
| 9,849,957 | B1 * | 12/2017 | Grahl | B63H 20/12 |
| 2004/0082235 | A1 | 4/2004 | Ochiai et al. | |
| 2005/0170712 | A1 | 8/2005 | Okuyama | |
| 2009/0084299 | A1 * | 4/2009 | Mizutani | B63H 25/26 114/144 RE |
| 2009/0171520 | A1 | 7/2009 | Kaji | |

FOREIGN PATENT DOCUMENTS

| | | |
|---|---|---|
| JP | 11-334693 A | 12/1999 |
| JP | 5859353 B2 | 2/2016 |

* cited by examiner

*Primary Examiner* — Lars A Olson
(74) *Attorney, Agent, or Firm* — Keating & Bennett, LLP

(57) ABSTRACT

An outboard motor includes a swivel bracket, an outboard motor body, a steering arm, an electric steering actuator, and a harness. The outboard motor body and the steering arm are turnable around a steering shaft supported by the swivel bracket. The electric steering actuator includes a movable body connected to the steering arm and that moves rightwardly and leftwardly. The harness includes a first drawn portion connected to the movable body and extending around and toward the outboard motor body and in a right-left direction that crosses a center of the swivel bracket in the right-left direction at least in a state in which the movable body is in a neutral position in the right-left direction.

14 Claims, 18 Drawing Sheets

OUTBOARD MOTOR

CROSS REFERENCE TO RELATED APPLICATIONS

This application claims the benefit of priority to Japanese Patent Application No. 2018-092954 filed on May 14, 2018. The entire contents of this application are hereby incorporated herein by reference.

BACKGROUND OF THE INVENTION

1. Field of the Invention

The present invention relates to an outboard motor.

2. Description of the Related Art

A vessel propulsion apparatus mentioned in Japanese Patent No. 5859353 includes an outboard motor body and a suspension device. The suspension device includes a clamp bracket that is attached to a rear portion of a hull, a swivel bracket connected to the clamp bracket through a tilt shaft, a steering shaft held by the swivel bracket, and an electric steering mechanism. The steering shaft is connected to the outboard motor body. The electric steering mechanism includes a housing that is attached to the swivel bracket and both an electric motor and a transmission that are housed in the housing. The transmission includes a ball screw supported by the housing and a ball nut attached to the ball screw. The ball nut is connected to a steering arm fixed to the steering shaft. When the electric motor rotates the ball screw, the ball nut moves rightwardly and leftwardly along the ball screw. Hence, the steering shaft and the outboard motor body turn rightwardly and leftwardly around a central axis of the steering shaft.

The present inventor has studied an arrangement in which the outboard motor body and a movable body that is connected to the steering arm and that moves rightwardly and leftwardly in the same way as the ball nut are connected together by a harness, so that the outboard motor body and an electric steering actuator are electrically connected together. In this arrangement, the harness is required to be located in a limited space between the outboard motor body and the movable body both of which move along mutually different paths, and is required to be prevented from being damaged, i.e., being cut off or being pinched.

SUMMARY OF THE INVENTION

In order to overcome the previously unrecognized and unsolved challenges described above, preferred embodiments of the present invention provide outboard motors each including a clamp bracket, a tilt shaft, a swivel bracket, a steering shaft, an outboard motor body, a steering arm, a steering actuator, and a flexible harness. The clamp bracket is attached to a hull. The tilt shaft extends rightwardly and leftwardly, and is connected to the clamp bracket. The swivel bracket is connected to the tilt shaft, and is turnable around the tilt shaft with respect to the clamp bracket. The steering shaft is supported by the swivel bracket, and extends upwardly and downwardly. The outboard motor body includes a propeller, and is turnable around the steering shaft. The steering arm extends farther forward than the steering shaft, and is turnable around the steering shaft together with the outboard motor body. The electric steering actuator includes a movable body. The movable body is located at a more forward position than the steering shaft, and is connected to the steering arm. The electric steering actuator is fixed to the swivel bracket, and moves the movable body rightwardly and leftwardly. The harness includes a first drawn portion connected to the movable body, and electrically connects the outboard motor body and the electric steering actuator together. The first drawn portion extends around and toward the outboard motor body in a right-left direction, and crosses a center of the swivel bracket in the right-left direction at least in a state in which the movable body is in a neutral position in the right-left direction.

With the above structural arrangement, when the electric steering actuator fixed to the swivel bracket moves the movable body rightwardly and leftwardly, the steering arm connected to the movable body turns around the steering shaft together with the outboard motor body. The harness by which the outboard motor body and the movable body of the electric steering actuator are connected includes the first drawn portion connected to the movable body. The first drawn portion extends around and toward the outboard motor body in the right-left direction, and crosses the center of the swivel bracket in the right-left direction at least in a state in which the movable body is in the neutral position in the right-left direction. The first drawn portion extends so that a difference in the moving path between the outboard motor body and the movable body is able to be absorbed by stretching or shrinking so as not to be caught on the outboard motor body being turned or on the movable body moving rightwardly and leftwardly, or so as not to be pinched between the outboard motor body and the swivel bracket or the like. This makes it possible to prevent the harness from being damaged.

In one preferred embodiment of the present invention, the first drawn portion has a C-shaped curved portion that is bent in C shape. With this structural arrangement, when the harness stretches or shrinks, the C-shaped curved portion is deformed mainly in an approaching-receding direction in which both ends of the C-shaped curved portion approach each other or recede from each other, and yet is not deformed much in a direction perpendicular to the approaching-receding direction. Therefore, the C-shaped curved portion is located so that a region, which is narrowed in accordance with the movement of the outboard motor body and the movement of the movable body in a space between the outboard motor body and the swivel bracket or the like, is not located in front of the C-shaped curved portion in the approaching-receding direction. As a result, it becomes possible to prevent the C-shaped curved portion from entering the region and from being pinched there. Therefore, it is possible to more reliably prevent the harness from being damaged.

In one preferred embodiment of the present invention, the first drawn portion includes an S-shaped curved portion that includes a plurality of the C-shaped curved portions that are continuous with each other. With this structural arrangement, the connecting portions of the C-shaped curved portions are mainly deformed when the harness stretches or shrinks, and therefore it becomes possible to absorb a difference in the moving path between the outboard motor body and the movable body even if the entire S-shaped curved portion is not deformed much. This makes it possible to prevent the S-shaped curved portion from being pinched between the outboard motor body and the swivel bracket or the like, or from being worn out by contact of the outboard motor body and the like with surrounding members, and therefore it is possible to more reliably prevent the harness from being damaged.

In one preferred embodiment of the present invention, the first drawn portion is connected to a front surface of the movable body, and extends around and behind the movable body while passing under the lower surface of the movable body. The outboard motor additionally includes a first positioner. The first positioner is fixed to a lower surface of the movable body, and positions the first drawn portion in the right-left direction.

With this structural arrangement, it is possible to prevent the first drawn portion from being cut off or being worn out because the first drawn portion moves rightwardly and leftwardly and rubs against the lower surface of the movable body and the like. This makes it possible to more reliably prevent the harness from being damaged.

In one preferred embodiment of the present invention, a connector that is connected to the front surface of the movable body in the first drawn portion is located at a position higher than the first positioner.

With this structural arrangement, it is possible to lengthen a portion from the first positioner to the connector in the first drawn portion, and therefore it is possible to effectively absorb a difference in the moving path between the outboard motor body and the movable body by stretching or shrinking this portion.

In one preferred embodiment of the present invention, the steering arm includes a front end that is connected from behind to the movable body at a position higher than the lower surface, and a rear end that is connected to the steering shaft. The front end is located at a position higher than the rear end.

With this structural arrangement, a space to locate a portion of the harness is provided below the steering arm. This makes it possible to prevent the harness from being damaged because the portion of the harness is not caught on the outboard motor body or the like.

In one preferred embodiment of the present invention, the outboard motor additionally includes a second positioner. The second positioner is fixed to the swivel bracket and positions the first drawn portion so as not to come into contact with the steering arm.

With this structural arrangement, the first drawn portion does not come into contact with the steering arm, and therefore it is possible to prevent the harness from being damaged.

In one preferred embodiment of the present invention, the outboard motor additionally includes a fastener that fixes the connector to the front surface. With this structural arrangement, it is possible to prevent the connector of the first drawn portion from moving and rubbing against surrounding members, and therefore it is possible to prevent the harness from being damaged.

In one preferred embodiment of the present invention, the fastener includes a cylindrical portion into which the first drawn portion is inserted, a ring portion integral with an end of the cylindrical portion, and a cover that sandwiches the ring portion between the front surface and the cover. The ring portion surrounds the connector of the first drawn portion that extends out from the cylindrical portion in the front surface. With this structural arrangement, it is possible to seal the connector with the ring portion so it does not become wet.

In one preferred embodiment of the present invention, the outboard motor additionally includes a duct that is fixed to the outboard motor body and into which a portion of the harness is inserted. With this structural arrangement, it is possible to prevent the harness from being damaged because a portion of the harness located in the duct is protected so as not to come into contact with members outside the duct.

In one preferred embodiment of the present invention, the harness includes a second drawn portion including an S-shaped curved portion that is bent in an S shape and that is connected to the outboard motor body. With this structural arrangement, it is possible to prevent the second drawn portion, which includes the S-shaped curved portion that has a small total deformation volume, from being pinched or being worn out, and therefore it is possible to more reliably prevent the harness from being damaged.

In one preferred embodiment of the present invention, the harness includes a plurality of electric wires bundled together. The plurality of electric wires are arranged in a line along the front surface of the movable body in the first drawn portion, and are arranged in a polygonal shape in the second drawn portion. With this structural arrangement, the first drawn portion of the plurality of electric wires arranged in a line is flat, and therefore it is possible to locate the first drawn portion in a narrow space so that the first drawn portion does not come into contact with surrounding members. The plurality of electric wires in the second drawn portion are arranged in a polygonal shape and hence move collectively when the harness stretches or shrinks, and therefore the plurality of electric wires do not come into contact with surrounding members. Therefore, it is possible to more reliably prevent the harness from being damaged.

In one preferred embodiment of the present invention, the outboard motor body includes a casing that is hollow, and an engine that is located in the casing and that generates a driving force by which the propeller is rotated. At least one portion of the second drawn portion is located between the casing and a side surface of the engine.

With this structural arrangement, at least one portion of the second drawn portion is located in a laterally narrow space between the casing and the side surface of the engine. When the one portion of the second drawn portion is the S-shaped curved portion and is disposed in the shape of the letter S in a lateral view, the one portion is not easily deformed laterally, and hence does not come into contact with the casing and the engine. Therefore, it is possible to more reliably prevent the harness from being damaged.

In one preferred embodiment of the present invention, the swivel bracket houses the movable body, and an opening into which the steering arm is inserted is provided in the swivel bracket. With this structural arrangement, it is possible to connect the steering arm to the movable body disposed in the swivel bracket by inserting the steering arm into the opening.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
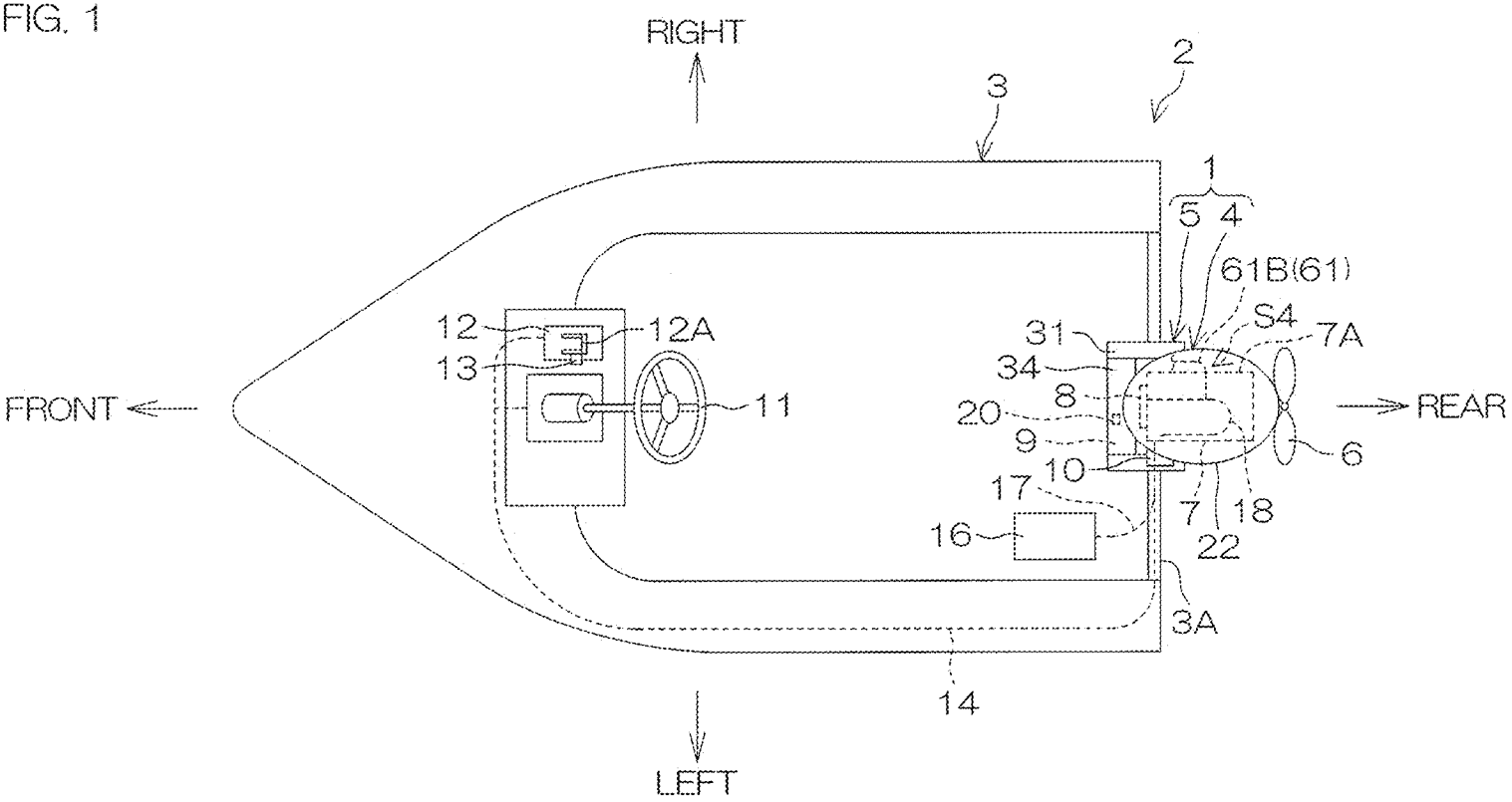
FIG. 1 is a schematic plan view to describe an arrangement of a vessel including an outboard motor according to a preferred embodiment of the present invention.

Preferred embodiments of the present invention will be hereinafter described in detail with reference to the accompanying drawings. FIG. 1 is a schematic plan view to describe an arrangement of a vessel 2 including an outboard motor 1 according to a preferred embodiment of the present invention. The vessel 2 additionally includes a hull 3. The outboard motor 1 includes an outboard motor body 4 that generates a thrust by which the hull 3 is propelled and a suspension device 5 by which the outboard motor body 4 is attached to a transom 3A disposed at a rear portion of the hull 3.

The outboard motor body 4 includes a propeller 6, an engine 7 that generates a driving force by which the propeller 6 is rotated, and an ECU (Engine Control Unit) 8 that controls the outboard motor 1. The outboard motor 1 additionally includes an electric steering actuator 9 that steers the outboard motor body 4 rightwardly and leftwardly and a tilt device 10 that tilts the outboard motor 1 in an up-down direction.

The hull 3 includes a steering wheel 11, a remote controller 12, and a tilt switch 13. The steering wheel 11 is electrically connected to an SCU (Steering Control Unit) 20 disposed in the electric steering actuator 9 through a CAN (Controller Area Network) 14 including communication lines. When the steering wheel 11 is operated by a vessel operator, an electric signal according to the operational direction and the operational amount of the steering wheel 11 is input directly into the SCU 20 through the CAN 14, and, based on this electric signal, the SCU 20 controls the electric steering actuator 9. Hence, the electric steering actuator 9 steers the outboard motor body 4 rightwardly and leftwardly. As a result, the direction of a thrust provided to the hull 3 changes rightwardly and leftwardly, and therefore the vessel 2 is steered.

The remote controller 12 includes an operation lever 12A electrically connected to the outboard motor 1 by the CAN 14. When the vessel operator operates the operation lever 12A, its operation signal is transmitted to a shift actuator (not shown) of the outboard motor 1 through the CAN 14 and the ECU 8. Hence, the shift position of the outboard motor 1 changes. In other words, the operation of the operation lever 12A enables the direction of a thrust of the outboard motor 1 to undergo switching between a forward direction and a rearward direction, and further enables the outboard motor 1 to reach a neutral state in which the power of the engine 7 is not transmitted to the propeller 6. Additionally, the operation signal of the operation lever 12A is transmitted to a throttle actuator (not shown) of the engine 7 through the ECU 8 of the outboard motor 1. Hence, the throttle opening degree of a throttle valve (not shown) of the engine 7 changes, and the output of the engine 7 varies in the outboard motor 1.

The tilt switch 13 is disposed at the operation lever 12A and the like in the remote controller 12, and is electrically connected to the ECU 8 through the CAN 14. When the tilt switch 13 is depressed by the vessel operator, an electric signal according to an energization time resulting from the operation of the tilt switch 13 is input into the ECU 8 through the CAN 14, and, based on this electric signal, the ECU 8 controls the tilt device 10. Hence, the tilt device 10 tilts the outboard motor 1 upwardly and downwardly.

A power source 16, such as a battery, is disposed in the hull 3. The power source 16 is connected to the outboard motor body 4 by a power supply line 17. Electric power output from the power source 16 is supplied to each electrical component disposed in the outboard motor body 4, to the electric steering actuator 9, and to the tilt device 10 through the power supply line 17. The CAN 14 and the power supply line 17 extend around an inside of the outboard motor body 4. The CAN 14 and the power supply line 17 disposed in the outboard motor body 4 are hereinafter referred to generically as "main harness(es) 18." The CAN 14 and the power supply line 17 may be provided as mutually different main harnesses 18 or may be bundled into a single main harness 18 in the outboard motor body 4.

Figure 2:
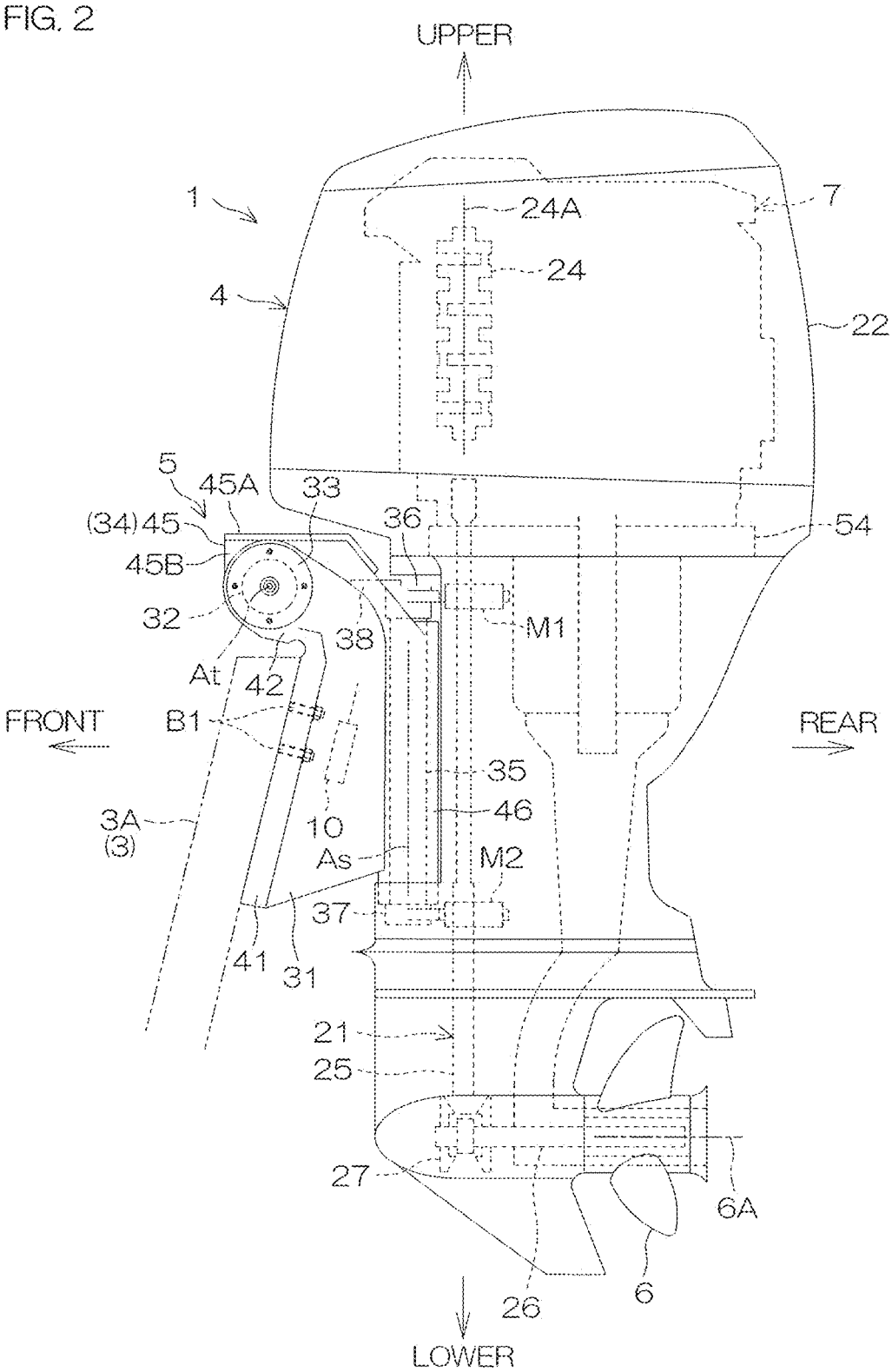
FIG. 2 is a left side view of the outboard motor.

FIG. 2 is a left side view of the outboard motor 1. A left side in FIG. 2 is a front side of the outboard motor 1, and a right side in FIG. 2 is a rear side of the outboard motor 1. A near side in the direction perpendicular to the plane of the paper of FIG. 2 is a left side of the outboard motor 1, and a far side in the direction perpendicular to the plane of the paper of FIG. 2 is a right side of the outboard motor 1. FIG. 2 shows the outboard motor body 4 in a tilt down position. The tilt down position is a position of the outboard motor body 4 when a rotational axis 6A of the propeller 6 extends in both a horizontal direction and a front-rear direction. The position of the outboard motor body 4 when the outboard motor body 4 is forwardly tilted and when the rotational axis 6A extends rearwardly and upwardly is a tilt up position. Unless otherwise specified, a description will be hereinafter provided of the outboard motor 1 in which the outboard motor body 4 is in the tilt down position.

The outboard motor body 4 includes the propeller 6, the engine 7, a power transmission 21 that transmits a driving force of the engine 7 to the propeller 6, and a hollow casing 22 that houses both the engine 7 and the power transmission 21. A crankshaft 24 is provided in the engine 7. The crankshaft 24 is rotatable around a rotational axis 24A that extends upwardly and downwardly. The power transmission 21 includes a drive shaft 25 that extends downwardly from the crankshaft 24, a propeller shaft 26 including a rear end to which the propeller 6 is attached, and a forward-rearward switching mechanism 27 by which a lower end of the drive shaft 25 and a front end of the propeller shaft 26 are connected together. The rotation of the crankshaft 24 is transmitted to the propeller 6 through the drive shaft 25, the forward-rearward switching mechanism 27, and the propeller shaft 26.

Figure 3:
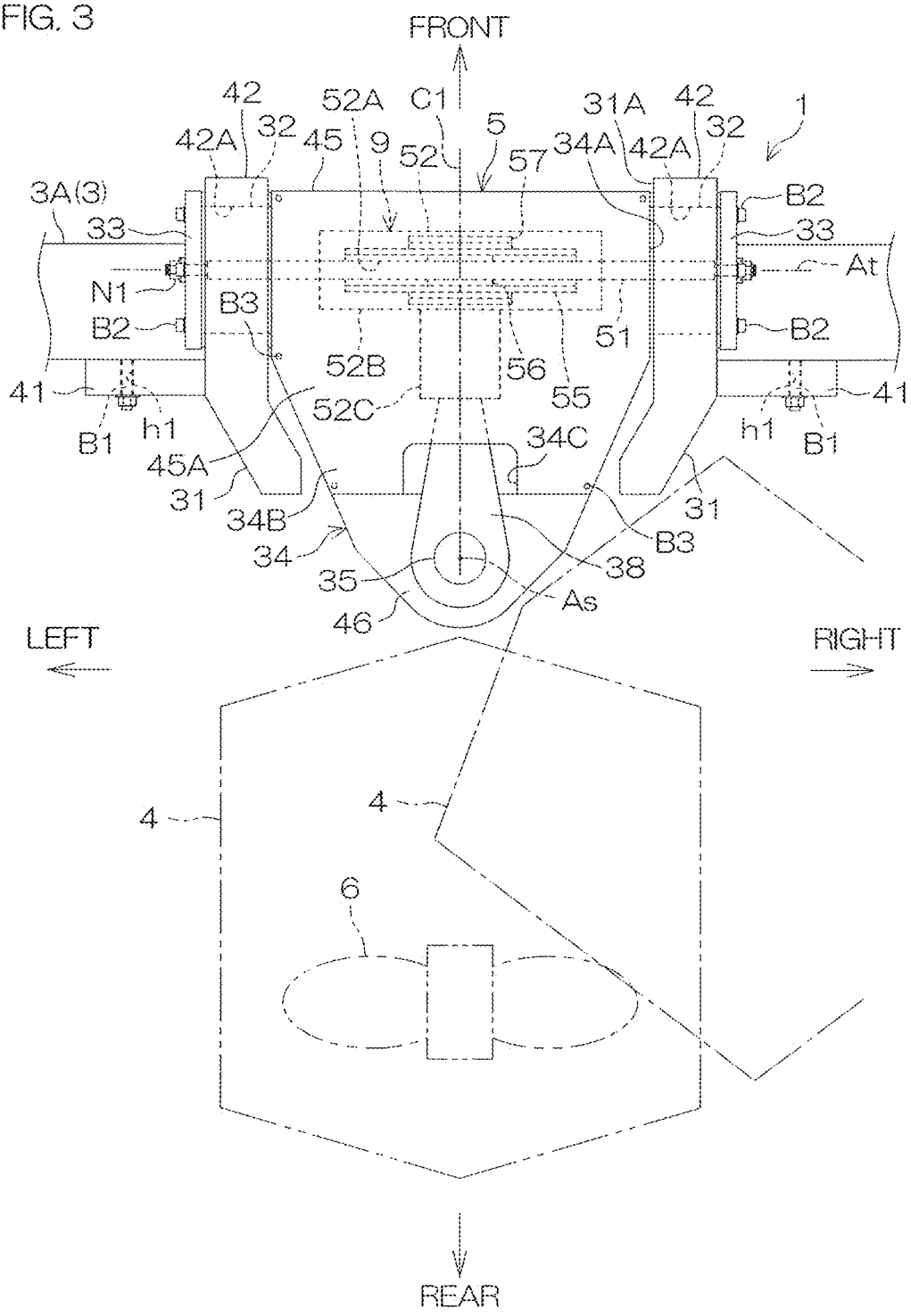
FIG. 3 is a plan view of a suspension device included in the outboard motor.

FIG. 3 is a plan view of the suspension device 5. In FIG. 3, the contour shape of an outer surface of the outboard motor body 4 at a height or substantially equal to a height of an upper end of the transom 3A of the hull 3 is shown by the alternate long and two short dashed line and the alternate long and short dashed line. The alternate long and two short dashed line represents a state in which the outboard motor body 4 is in the original position between the rightward maximum steering position and the leftward maximum steering position. The alternate long and short dashed line represents a state in which the outboard motor body 4 is in the rightward maximum steering position.

The suspension device 5 includes a clamp bracket 31, a tilt shaft 32, an end cap 33, a swivel bracket 34, and a steering shaft 35. The suspension device 5 includes an upper mounting bracket 36, a lower mounting bracket 37, and a steering arm 38 (see FIG. 2).

The clamp bracket 31 includes a pair of brackets, and one of the paired clamp brackets 31 is located on the left side of the swivel bracket 34, and the other one is located on the right side of the swivel bracket 34. An inner surface 31A of each clamp bracket 31 faces an outer surface 34A of the swivel bracket 34. The clamp bracket 31 includes an attachment 41 that is attached to the transom 3A of the hull 3 and a swivel support 42 that supports the swivel bracket 34. The attachment 41 is located behind the transom 3A. The swivel support 42 is located above the transom 3A. A cylindrical through-hole 42A that passes through the swivel support 42 rightwardly and leftwardly is provided in the swivel support 42. A bolt B1, for example, is inserted into a bolt attaching hole h1 providing in the attachment 41, and is incorporated into the transom 3A. Hence, the clamp bracket 31 is attached to the hull 3.

The tilt shaft 32 preferably has a circular or substantially circular tubular shape and extends rightwardly and leftwardly, and has an outer diameter substantially equal to an inner diameter of the through-hole 42A of each of the pair of clamp brackets 31. The tilt shaft 32 includes a pair of shafts, and is fitted into the through-hole 42A of each of the pair of clamp brackets 31 one by one. Hence, the tilt shaft 32 is connected to the clamp bracket 31. The tilt shaft 32 in this state is turnable around a tilt axis At that extends rightwardly and leftwardly through its center.

The end cap 33 is preferably disk shaped, and a thickness direction of the end cap 33 coincides with a right-left direction. The end cap 33 includes a pair of caps, and the paired end caps 33 are spaced apart from each other on the right and left sides, respectively. The left end cap 33 is located more leftwardly than the left clamp bracket 31, and is fixed to the left clamp bracket 31 or to the left tilt shaft 32 by a bolt B2, for example. Hence, the left end cap 33 plugs an internal space of the left tilt shaft 32 from the left side. The right end cap 33 is located more rightwardly than the right clamp bracket 31, and is fixed to the right clamp bracket 31 or to the right tilt shaft 32 by a bolt B2, for example. Hence, the right end cap 33 plugs an internal space of the right tilt shaft 32 from the right side.

The swivel bracket 34 includes a box-shaped housing 45 and a cylindrical shaft support 46 that extends upwardly and downwardly. The housing 45 is located between the pair of tilt shafts 32, and is connected to the tilt shafts 32. The left tilt shaft 32 protrudes leftwardly from the housing 45. The right tilt shaft 32 protrudes rightwardly from the housing 45. An internal space of the housing 45 is connected to an internal space of each of the right and left tilt shafts 32. The tilt shaft 32 may be integral with the housing 45 as a portion of the swivel bracket 34. The shaft support 46 is located at a more rearward position than the housing 45. The swivel bracket 34 is turnable with respect to the clamp bracket 31 around the tilt axis At of the tilt shaft 32 together with the tilt shaft 32.

The steering shaft 35 extends upwardly and downwardly, and is inserted into the inside of the shaft support 46. Hence, the steering shaft 35 is supported by the shaft support 46. The steering shaft 35 in this state is turnable around a steering axis As that extends upwardly and downwardly through its center. An upper end of the steering shaft 35 bulges upwardly from the shaft support 46, and a lower end of the steering shaft 35 bulges downwardly from the shaft support 46 (see FIG. 2).

The upper mounting bracket 36 extends rearwardly from the upper end of the steering shaft 35, and is connected to an upper damper mount M1 disposed in the outboard motor body 4 (see FIG. 2). The lower mounting bracket 37 extends rearwardly from the lower end of the steering shaft 35, and is connected to a lower damper mount M2 disposed in the outboard motor body 4 (see FIG. 2). The steering arm 38 extends more forwardly than the steering shaft 35 from the upper end of the steering shaft 35. The upper mounting bracket 36, the lower mounting bracket 37, and the steering arm 38 are turnable around the steering axis As of the steering shaft 35 together with the outboard motor body 4 and the steering shaft 35.

The electric steering actuator 9 is fixed to the swivel bracket 34. The electric steering actuator 9 includes a rod 51 and a movable body 52 that are each located at a more forward position than the steering shaft 35.

The rod 51 is located in an internal space of the housing 45 and of the right and left tilt shafts 32, and extends rightwardly and leftwardly on the tilt axis At. A left end of the rod 51 is fixed to the left end cap 33 by, for example, a nut N1. Hence, the rod 51 is supported in a cantilever manner. A right end of the rod 51 may be fixed to the right end cap 33 by, for example, another nut N1.

The movable body 52 is housed in the internal space of the housing 45. A through-hole 52A that passes through the movable body 52 rightwardly and leftwardly is provided in the movable body 52. The rod 51 and the movable body 52 are connected together by inserting the rod 51 into the through-hole 52A. The movable body 52 is movable rightwardly and leftwardly along the rod 51. As an example for that, the movable body 52 includes an inner cylinder 55 that surrounds the rod 51, a plurality of roller screws 56 that are annularly arranged between the rod 51 and the inner cylinder 55 and that are engaged with the rod 51 and the inner cylinder 55, and an electric motor 57, which are built-in components. When the electric motor 57 rotates the inner cylinder 55, the entire movable body 52 moves rightwardly and leftwardly.

The movable body 52 may be moved rightwardly and leftwardly by a ball screw mechanism including a ball screw provided at the rod 51, a ball nut that is built into the movable body 52 and that surrounds the ball screw, and an electric motor that is built into the movable body 52 and that rotates the rod 51 or the ball screw. Additionally, as another example, the movable body 52 may be moved rightwardly and leftwardly by oil pressure generated by a motor pump (not shown) in the movable body 52.

Figure 4:
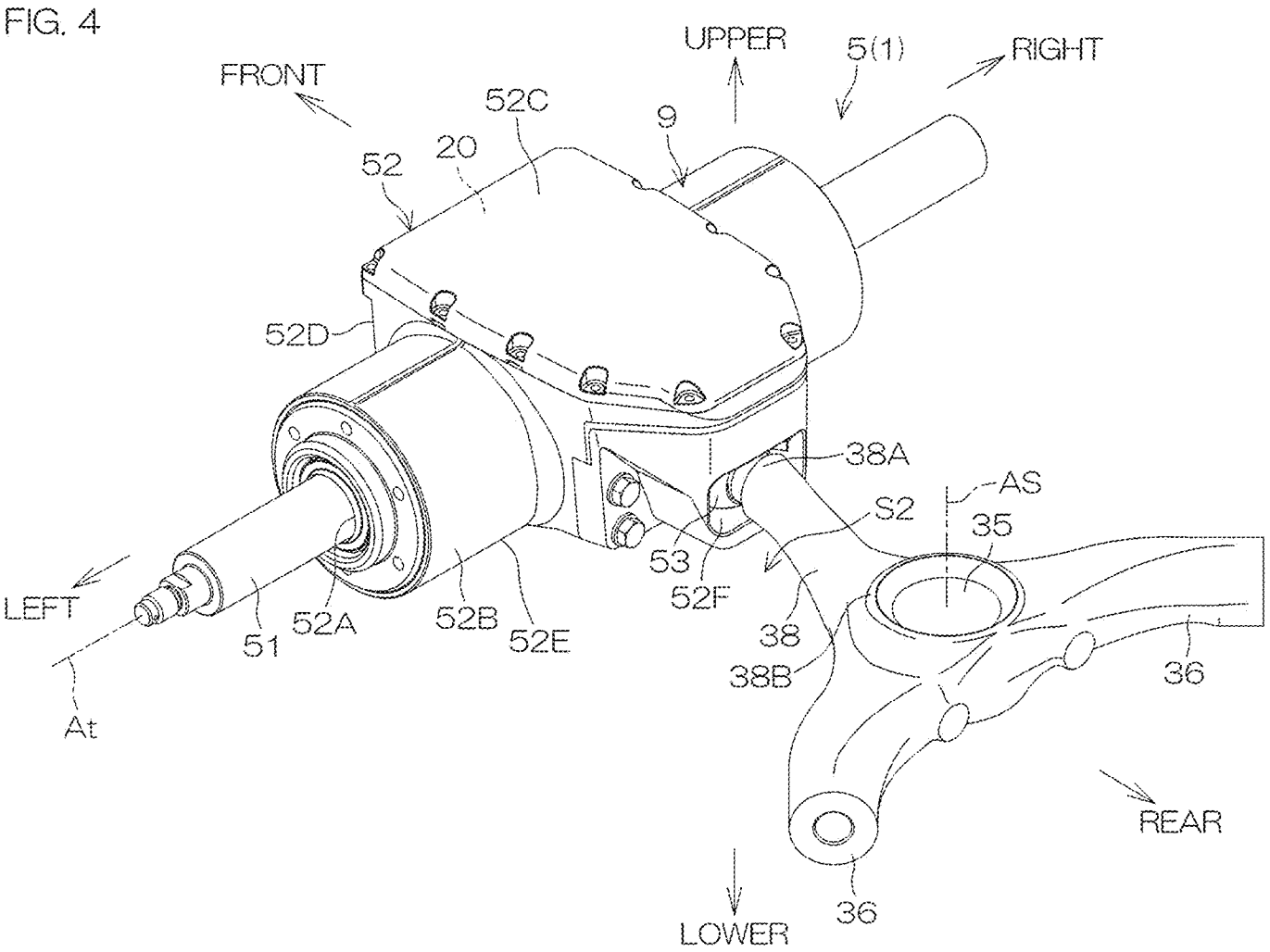
FIG. 4 is a perspective view of an electric steering actuator and a steering arm that are included in the outboard motor.

FIG. 4 is a perspective view of the electric steering actuator 9 and the steering arm 38. The movable body 52 includes a main portion 52B and a central portion 52C. The main portion 52B preferably has a cylindrical or substantially cylindrical shape and extends rightwardly and leftwardly. The through-hole 52A of the movable body 52 passes through the center of the main portion 52B. The central portion 52C is positioned at the center of the main portion 52B in the right-left direction, and is preferably box shaped or substantially box shaped. The SCU 20 that controls the electric motor 57 is built into the central portion 52C. A front surface of the central portion 52C extends upwardly and downwardly, and is located at a more forward position than the main portion 52B, and defines a front surface 52D of the movable body 52. A lower outer peripheral surface of the main portion 52B is located below the central portion 52C, and defines a lower surface 52E of the movable body 52. A rear end of the central portion 52C is located at a more rearward position than the main portion 52B. An insertion hole 52F that is hollow in a forward direction is provided in a rear surface of the central portion 52C. A universal joint 53, such as a ball joint, is provided in the insertion hole 52F.

Figure 5:
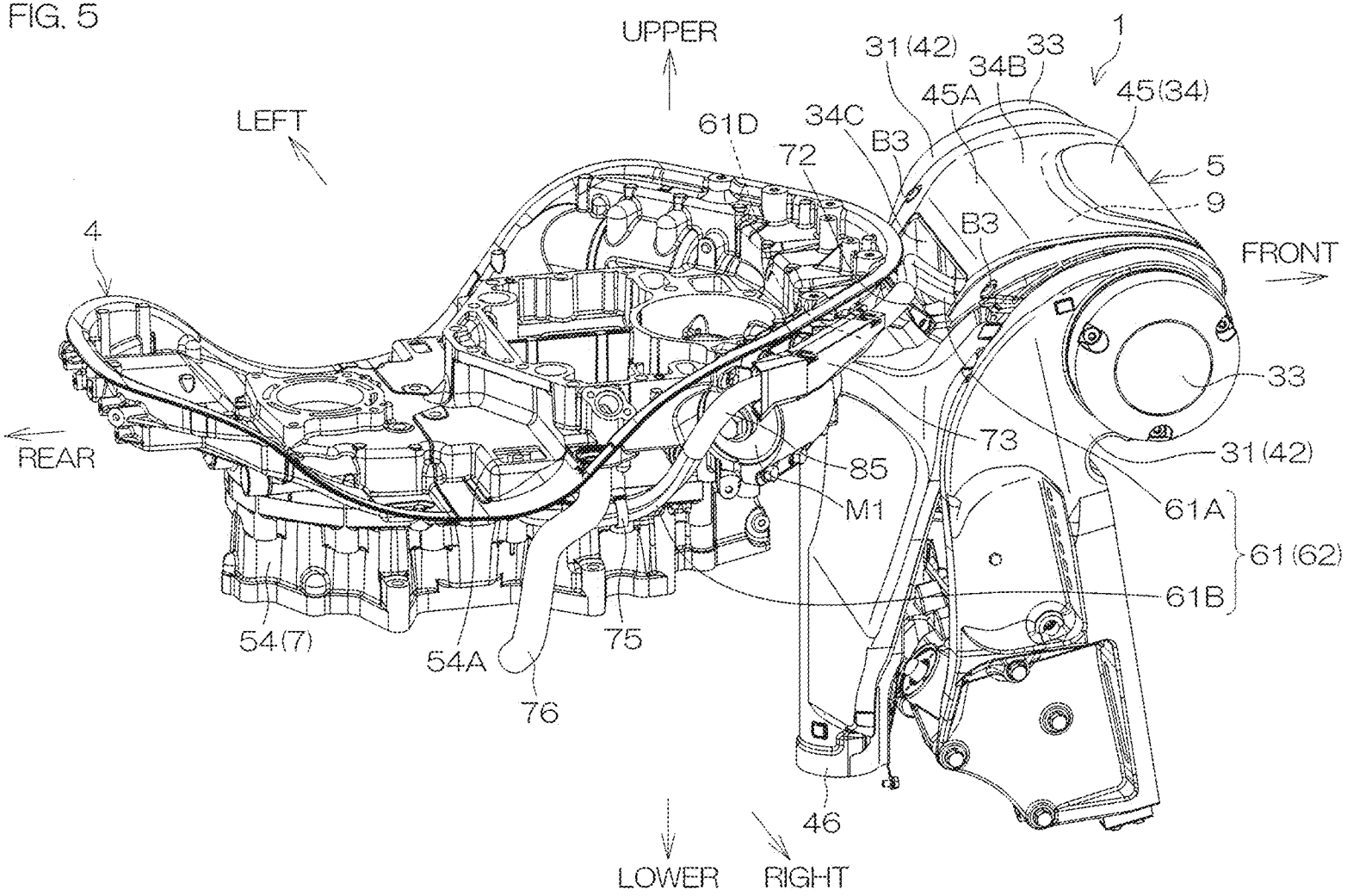
FIG. 5 is a perspective view of a portion of an outboard motor body and the suspension device.

FIG. 5 is a perspective view of a portion of the outboard motor body 4 and the suspension device 5. In FIG. 5, the engine 7 (strictly, an exhaust guide 54 on which the engine 7 is mounted) is shown as a portion of the outboard motor body 4. An upper surface of a ceiling wall 45A of the housing 45 that houses the movable body 52 in the swivel bracket 34 defines an outer surface 34B of the swivel bracket 34. The ceiling wall 45A, which defines and functions as a swivel cover, is fixed to an upper end of each of left and right walls 45B and 45C of the housing 45 (see FIG. 11 described later) by a bolt B3, for example. A rear end of the outer surface 34B faces the outboard motor body 4 from the front with a gap between the rear end and the outboard motor body 4, and an opening 34C is defined in the rear end of the outer surface 34B. The opening 34C has a rectangular or substantially rectangular shape that is elongated rightwardly and leftwardly, and defines a cut-out in a rear end of the ceiling wall 45A.

The insertion hole 52F of the movable body 52 shown in FIG. 4 faces the outside of the housing 45 from the opening 34C. The steering arm 38 extends upwardly and forwardly, and its front end 38A is inserted into the opening 34C and is connected to the universal joint 53. The front end 38A is connected to the movable body 52 from behind through the universal joint 53 at a position higher than the lower surface 52E of the movable body 52. The front end 38A is located at a position higher than a rear end 38B connected to the steering shaft 35 in the steering arm 38.

The movable body 52 located at or substantially at the center of the rod 51 in the right-left direction is a neutral position in the right-left direction as shown in FIG. 4. The neutral position of the movable body 52 is a center position in the right-left direction within the moving range of the movable body 52. When the movable body 52 is in the neutral position, the outboard motor body 4 is in the original position (see the alternate long and two short dashed line of FIG. 3). When the movable body 52 moves leftwardly from the neutral position to a left limit position, the outboard motor body 4 turns rightwardly to the rightward maximum steering position (see the alternate long and short dashed line of FIG. 3, and see FIG. 15 described later). When the movable body 52 moves rightwardly from the neutral position to a right limit position, the outboard motor body 4 turns leftwardly to the leftward maximum steering position (see FIG. 17 described later).

Referring again to FIG. 5, the outboard motor 1 includes a harness 61 by which the outboard motor body 4 and the electric steering actuator 9 are electrically connected together. The harness 61 includes an electric wire 62 coated with an insulating material, such as rubber, and is flexible. In the present preferred embodiment, the outboard motor 1 includes a plurality of electric wires 62 (for example, four electric wires 62), and the electric wires 62 are bundled together. The harness 61 branches from the main harness 18 (see FIG. 1) in the outboard motor body 4, and is connected to the movable body 52 in the housing 45 of the swivel bracket 34 through the opening 34C of the swivel bracket 34. The harness 61 includes a first drawn portion 61A that is connected to the movable body 52, and a second drawn portion 61B.

Figure 6:
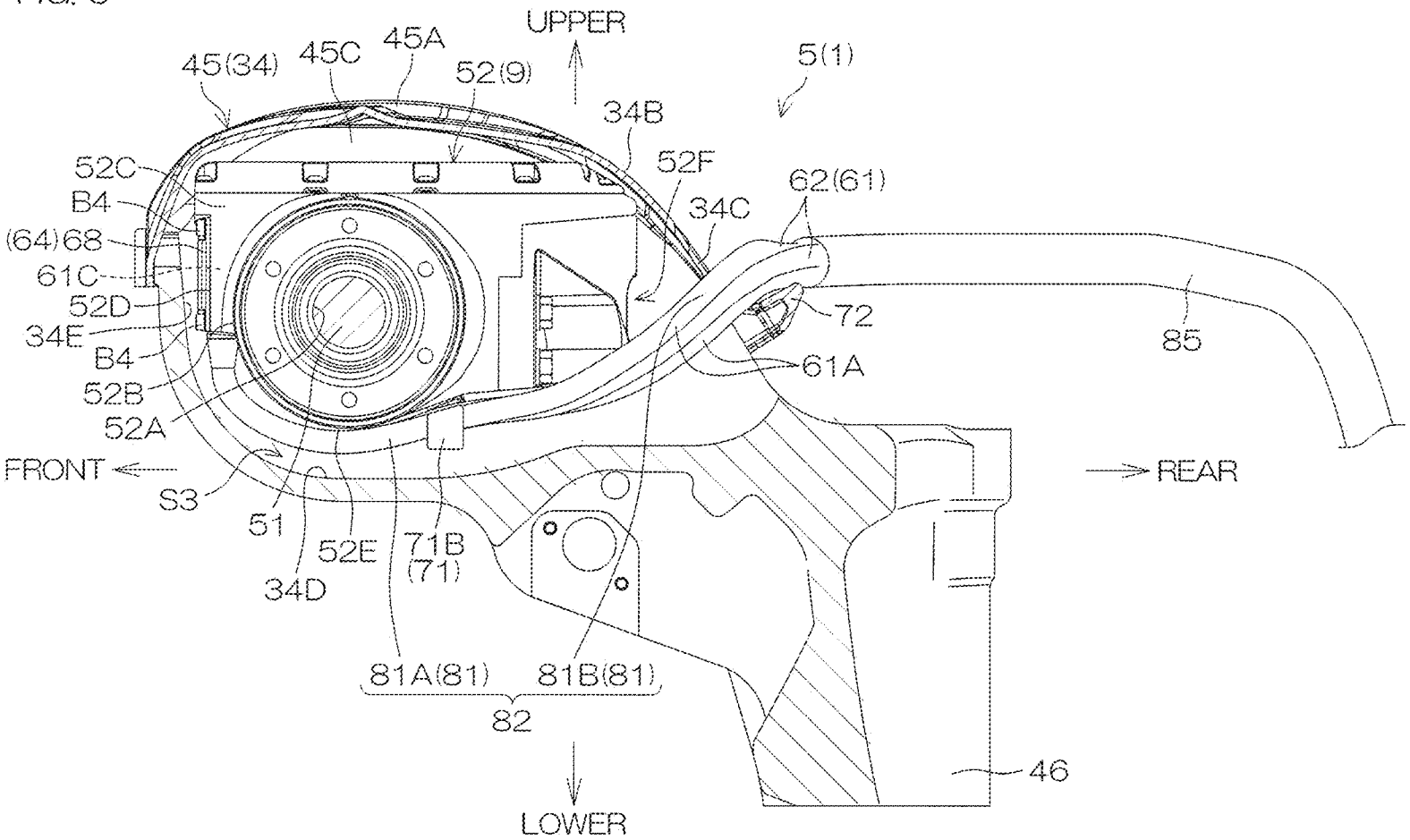
FIG. 6 is a longitudinal sectional left side view of the electric steering actuator and a swivel bracket of the suspension device.

FIG. 6 is a longitudinal sectional left side view of the electric steering actuator 9 and the swivel bracket 34. The first drawn portion 61A is connected to the front surface 52D of the movable body 52 in the housing 45 of the swivel bracket 34, and is drawn around behind the movable body 52 while extending under the lower surface 52E of the movable body 52 and curving along the outer peripheral surface of the main portion 52B of the movable body 52. The first drawn portion 61A is further extended around rightward and rearwardly toward the outboard motor body 4 through the opening 34C of the swivel bracket 34.

Figure 7:
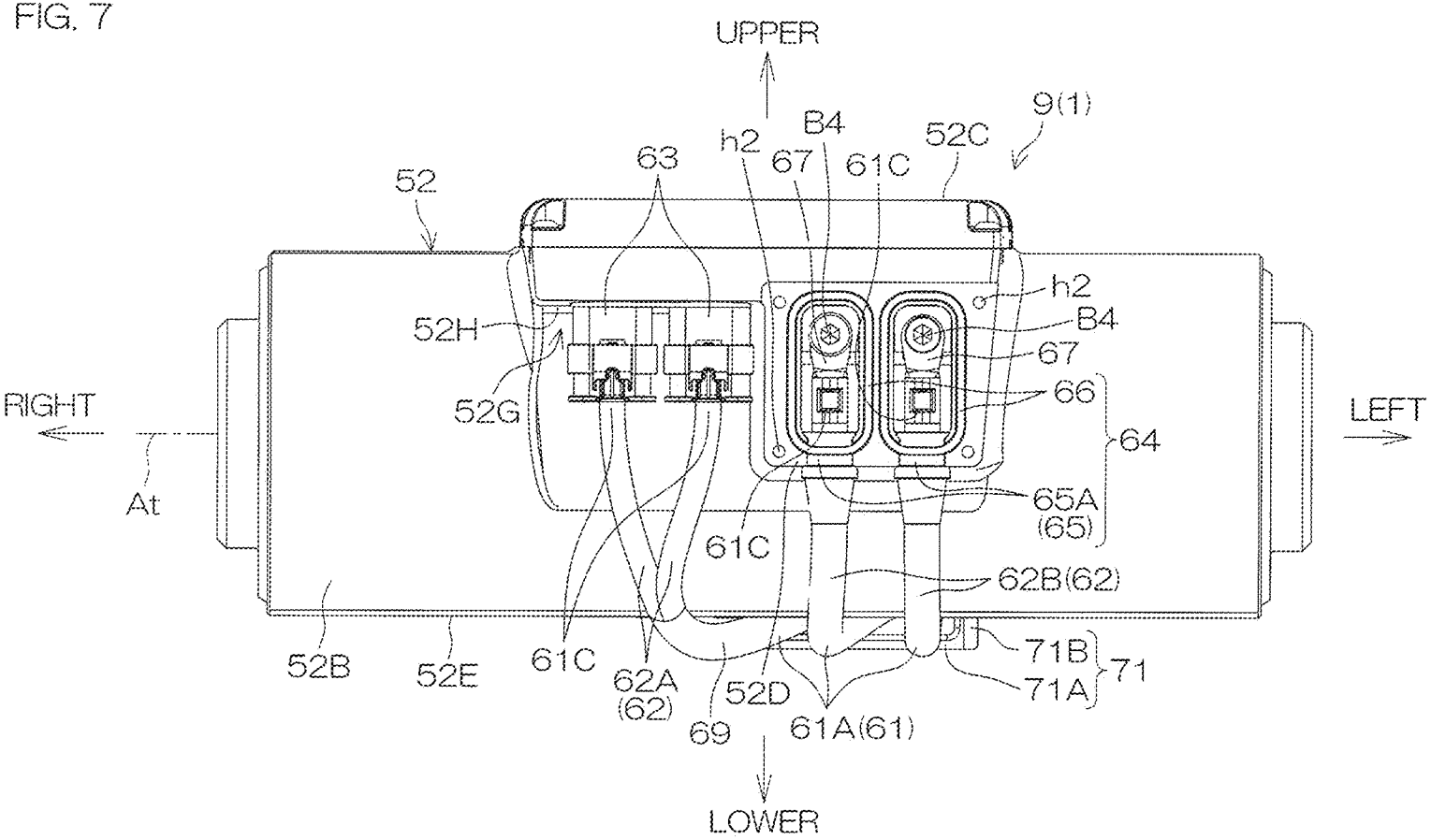
FIG. 7 is a front view of a movable body of the electric steering actuator.

FIG. 7 is a front view of the movable body 52. A portion, which is connected to the front surface 52D of the movable body 52, of the first drawn portion 61A is referred to as a connector 61C. For example, two electric wires 62 among the four electric wires 62 of the harness 61 are signal wires 62A, and a waterproof connector 63 is disposed at each of the connectors 61C of the two signal wires 62A. A recess 52G and a flat surface 52H that extends rightwardly and leftwardly and edges an upper end of the recess 52G are provided in a right region of the front surface 52D. The two connectors 63 are located right and left of at the recess 52G, and are connected to a terminal (not shown) provided at the flat surface 52H. Thus, in the movable body 52, the SCU 20 (see FIG. 4) controls the operation of the electric motor 57 in accordance with an electric signal input directly into the SCU 20 through the CAN 14 and through the signal wire 62A from the steering wheel 11. The two signal wires 62A are bundled into one by, for example, a rubber tube 69. Therefore, in each figure, there is a case in which the electric wires 62 are depicted not as four electric wires but as three electric wires.

The remaining two electric wires 62 among the four electric wires 62 of the harness 61 are power supply wires 62B, and the outboard motor 1 additionally includes a fastener 64 that fixes the connectors 61C of the two power supply wires 62B to a left region of the front surface 52D. The fastener 64 includes a cylindrical portion 65 and a ring portion 66. The cylindrical portion 65 and the ring portion 66 are made of, for example, rubber, and are preferably integral with each other. A plurality of each of the cylindrical portion 65 and the ring portion 66 are provided (in the present preferred embodiment, two) corresponding to the connectors 61C of the two power supply wires 62B. The cylindrical portion 65 includes a grommet that preferably has a cylindrical or substantially cylindrical shape that extends upwardly and downwardly. The ring portion 66 includes an O-ring that preferably has an annular or substantially annular shape that is vertically elongated in a front view, and its lower end is connected to an upper end 65A of the cylindrical portion 65. The first drawn portion 61A in the power supply wire 62B is inserted into the cylindrical portion 65 from below. A portion, which extends upwardly from the cylindrical portion 65, of the first drawn portion 61A is the connector 61C in the power supply wire 62B, and is surrounded by the ring portion 66 in a front view in a left region of the front surface 52D. For example, a ring terminal 67 is disposed at an upper end of the connector 61C. The ring terminal 67 is connected to a terminal (not shown) disposed in the left region of the front surface 52D by a bolt B4, for example. Thus, electric power is supplied from the power source 16 (see FIG. 1) to the SCU 20 (see FIG. 4) and to the electric motor 57 of the movable body 52.

Figure 8:
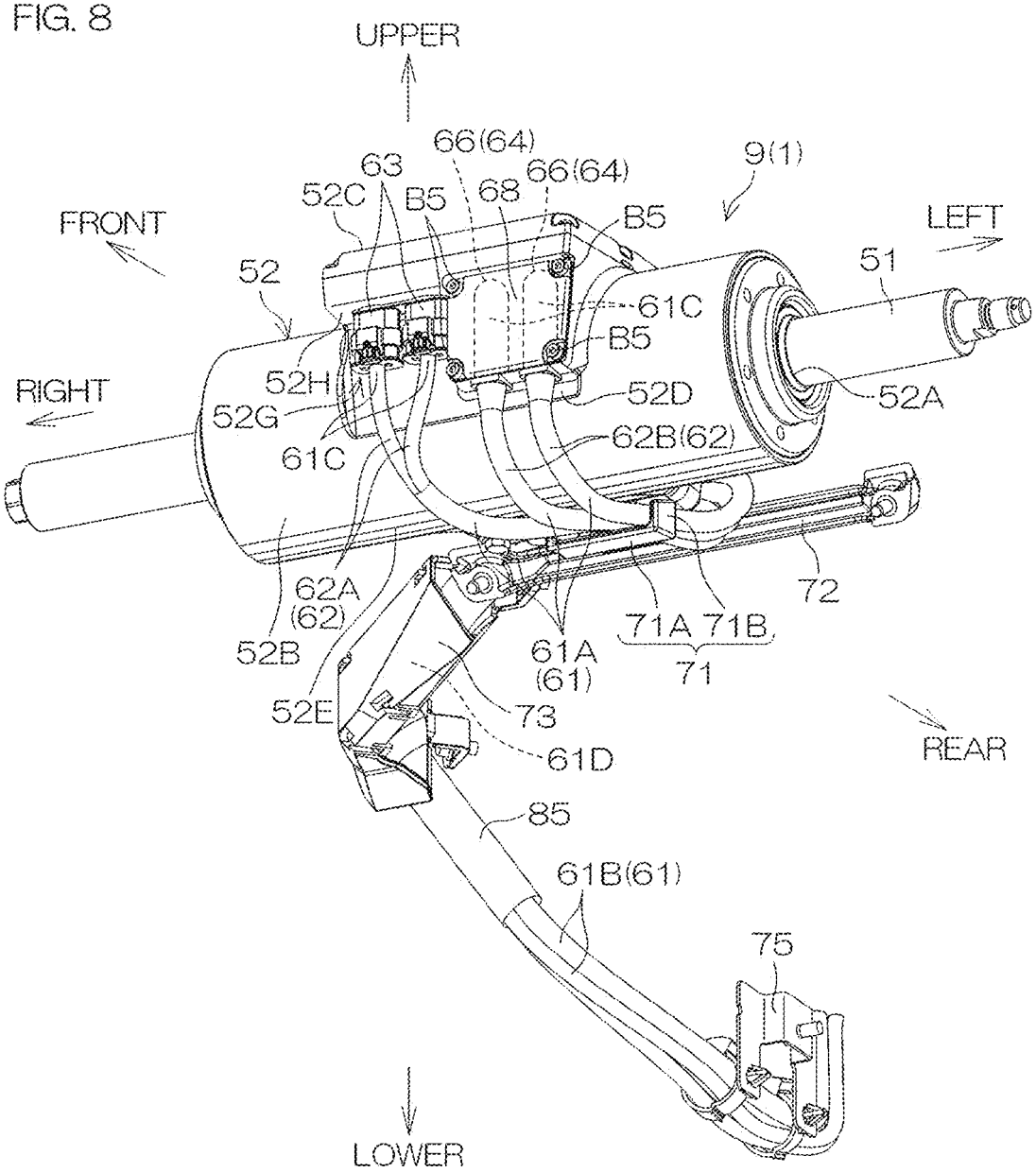
FIG. 8 is a perspective view of the electric steering actuator and a harness.

FIG. 8 is a perspective view of the electric steering actuator 9 and the harness 61. The fastener 64 additionally includes a cover 68. The cover 68 preferably has a rectangular or substantially rectangular flat plate shape, and a thickness direction of the cover 68 coincides with the front-rear direction. The cover 68 faces the left region of the front surface 52D from the front. The cover 68 is fixed to the left region by bolts B5, for example, that extend through the four corners of the cover 68, respectively, and each of which is incorporated into a bolt attaching hole h2 (see FIG. 7) of the left region of the front surface 52D. The cover 68 in this state sandwiches the ring portion 66 of each of the fasteners 64 between the cover 68 and the left region of the front surface 52D. The connector 61C of the power supply wire 62B in the ring portion 66 is sealed by bringing the ring portion 66 into close contact with the cover 68 and with the front surface 52D.

Figure 9:
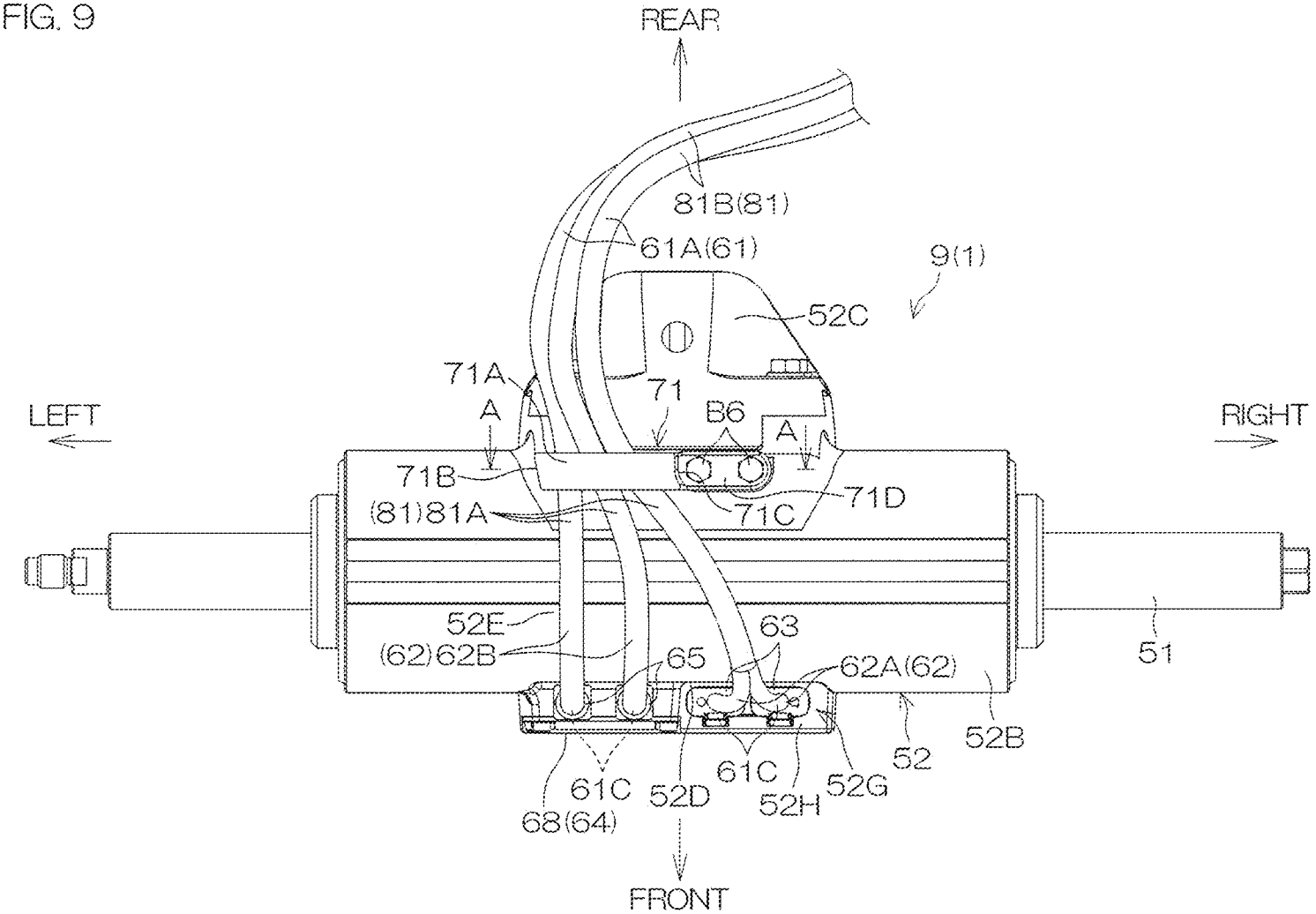
FIG. 9 is a bottom view of the electric steering actuator.

In relation to the first drawn portion 61A of the harness 61, the outboard motor 1 additionally includes a first positioner 71 and a second positioner 72. FIG. 9 is a bottom view of the electric steering actuator 9.

Figure 10:
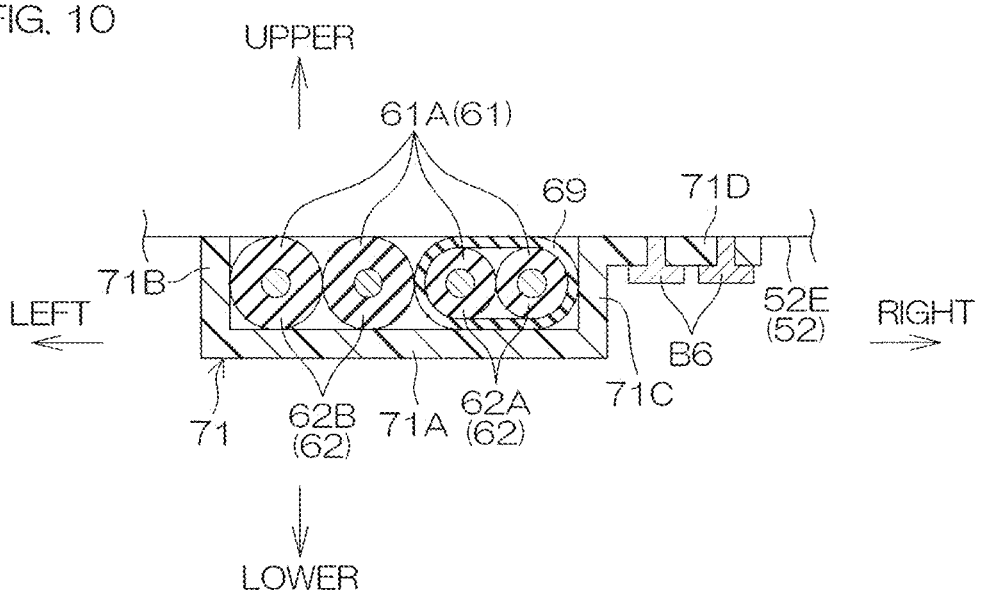
FIG. 10 is a cross-sectional view taken along line A-A in FIG. 9.

The first positioner 71 is preferably U-shaped or substantially U-shaped that is elongated right and left and that is flat up and down. The first positioner 71 integrally includes a horizontal portion 71A that horizontally extends rightwardly and leftwardly, a left longitudinal portion 71B that rises from a left end of the horizontal portion 71A, a right longitudinal portion 71C that rises from a right end of the horizontal portion 71A, and an extension portion 71D that extends rightwardly from an upper end of the right longitudinal portion 71C. The first positioner 71 is fixed to the lower surface 52E by incorporating the extension portion 71D into the lower surface 52E of the movable body 52 by bolts B6, for example. The four electric wires 62 in the first drawn portion 61A are mounted on the horizontal portion 71A in a line extending rightwardly and leftwardly along the lower surface 52E of the movable body 52 in a cross-sectional view as shown in FIG. 10, and are located between the left longitudinal portion 71B and the right longitudinal portion 71C. Hence, the first drawn portion 61A is positioned in the right-left direction. The connector 61C of the first drawn portion 61A is located at a position higher than the first positioner 71 (see FIG. 6).

Figure 11:
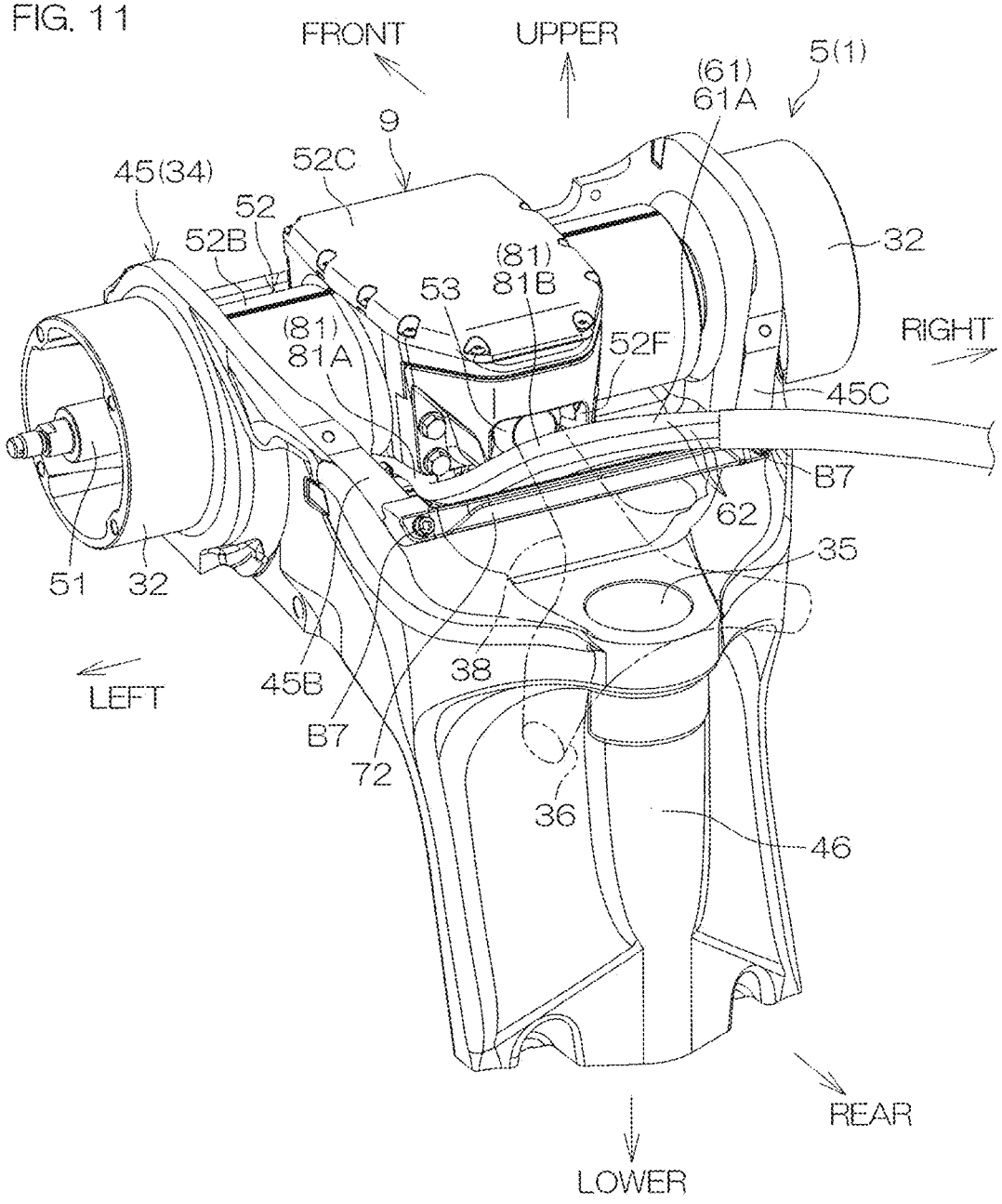
FIG. 11 is a perspective view of the electric steering actuator and the swivel bracket.

FIG. 11 is a perspective view of the electric steering actuator 9 and the swivel bracket 34. In FIG. 11, a state in which the ceiling wall 45A (see FIG. 5) has been detached from the housing 45 of the swivel bracket 34 is shown. The second positioner 72 is preferably arm shaped or substantially arm shaped that extends rightwardly and leftwardly, and is located between a rear end of the left wall 45B and a rear end of the right wall 45C of the housing 45. A left end and a right end of the second positioner 72 in this state press down a rear end of the ceiling wall 45A from above (not shown). The left end of the second positioner 72 is fixed to the left wall 45B by a bolt B7, for example, and the right end of the second positioner 72 is fixed to the right wall 45C by another bolt B7, for example. The second positioner 72 crosses a space above the steering arm 38 rightwardly and leftwardly. The first drawn portion 61A of the harness 61 is mounted on the second positioner 72, and thus is spaced upwardly away from the steering arm 38. In other words, the second positioner 72 positions the first drawn portion 61A so as not come into contact with the steering arm 38. Portions, which are located between the first positioner 71 and the second positioner 72, of the four electric wires 62 of the harness 61 are twisted and bundled together so as have a polygonal shape. Although the polygonal shape may have a quadrangular shape because the number of electric wires 62 is four, the polygonal shape may have a triangular shape if the two signal wires 62A are bundled into one as described above. A portion, which has been mounted on the second positioner 72, of the four electric wires 62 and a portion, which has been located more rearwardly than the second positioner 72, of the electric wires 62 extend around rightwardly from the engine 7 in a state having the polygonal shape.

Figure 12:
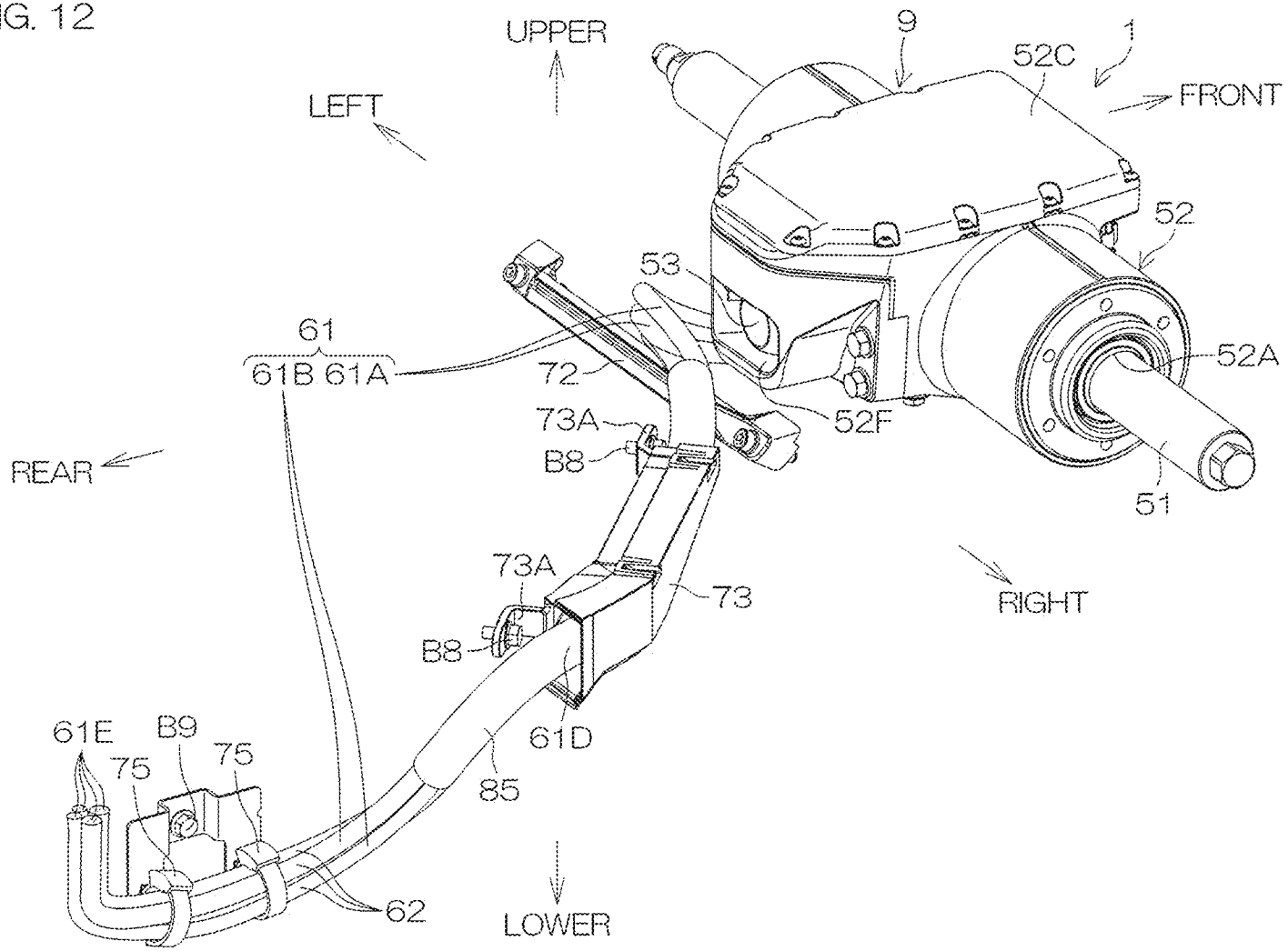
FIG. 12 is a perspective view of the electric steering actuator and the harness.

FIG. 12 is a perspective view of the electric steering actuator 9 and the harness 61. The outboard motor 1 additionally includes a duct 73. The duct 73 is made of, for example, resin, and preferably has a tubular or substantially tubular shape that extends forwardly and rearwardly. The duct 73 may have a square tubular shape as shown in FIG. 12, or may have a circular tubular shape. The sectional shape of the inside of the duct 73 viewed when the duct 73 is cut along a plane perpendicular to its axis may have a polygonal shape defined by the four electric wires 62. A stay 73A that extends leftwardly and that bends forwardly or rearwardly is disposed at a front end and at a rear end of a left side surface of the duct 73. A bolt B8, for example, attached to the stay 73A is incorporated into the exhaust guide 54 or the like (see FIG. 5), and, as a result, the duct 73 is fixed to the outboard motor body 4. A halfway portion 61D of the harness 61 is inserted into the duct 73. The halfway portion 61D attaches the first drawn portion 61A and the second drawn portion 61B together.

The second drawn portion 61B is located at a more rearward position than the halfway portion 61D of the harness 61. The second drawn portion 61B is connected to the main harness 18 provided within the outboard motor body 4 through a through-hole 54A (see FIG. 5) provided in the exhaust guide 54, for example. The four electric wires 62 bundled together in the harness 61 have a polygonal shape as discussed above in the second drawn portion 61B. In order that the polygonal shape can be understood, the second drawn portion 61B is depicted in a discontinuous state in FIG. 12, and its cross section 61E (cross section of the four electric wires 62) is shown (the same applies to FIG. 13, FIG. 15, and FIG. 17 described later). At least one portion of the second drawn portion 61B is located between the casing 22 and a side surface 7A on the right side of the engine 7 in the outboard motor body 4 (see FIG. 1). A portion facing the side surface 7A of the engine 7 in the casing 22 may be a so-called apron. The outboard motor 1 includes a binding 75 by which a plurality of electric wires 62 in the second drawn portion 61B are bundled together and, which is fixed to the exhaust guide 54 or the like by a bolt B9, for example. The bundle of the electric wires 62 in the second drawn portion 61B may be fixed to a hose 76 attached to the exhaust guide 54 that provides cooling water for cooling the engine 7 or the like (see FIG. 5).

Figure 13:
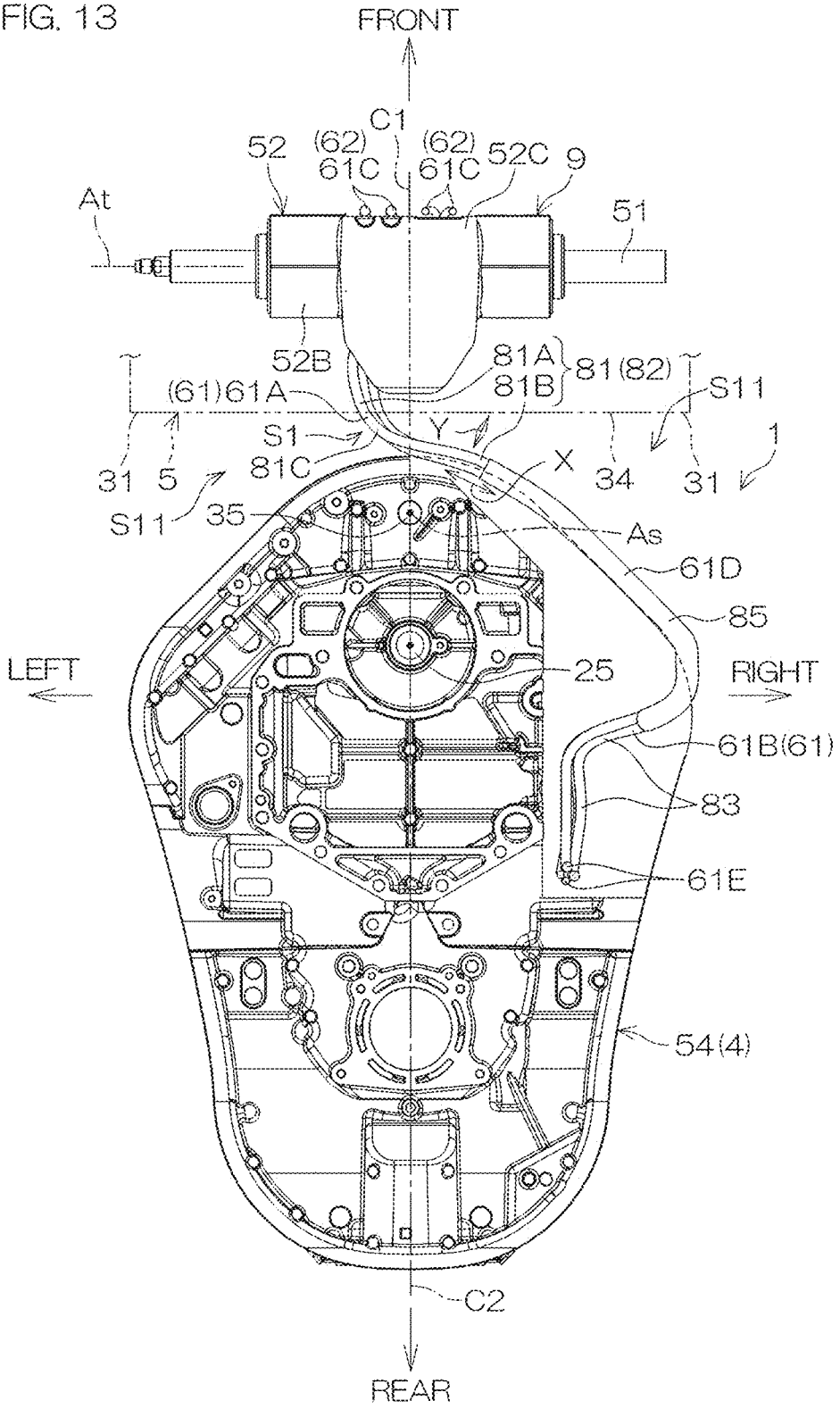
FIG. 13 is a plan view of the outboard motor body, the electric steering actuator, and the harness when the outboard motor body is in an original position.

FIG. 13 is a plan view of the outboard motor body 4, the electric steering actuator 9, and the harness 61 when the outboard motor body 4 is in the original position. In FIG. 13, a center C1 of the swivel bracket 34 in the right-left direction is shown. The center C1 is a line extending in the front-rear direction, and is located at the same position in the right-left direction as the steering axis As. In a state in which the outboard motor body 4 is in the original position and in which the movable body 52 of the electric steering actuator 9 is in the neutral position as shown in FIG. 13, the first drawn portion 61A of the harness 61 extends and crosses the center C1 in the right-left direction in such a way as to straddle the center C1 from the left side to the right side in a plan view.

The first drawn portion 61A includes a C-shaped curved portion 81 that is bent so as to have the shape of the letter C. The first drawn portion 61A includes a plurality of C-shaped curved portions 81 (in the present preferred embodiment, two C-shaped curved portions 81) that are continuous with each other. The C-shaped curved portions 81 include a first C-shaped curved portion 81A that is closest to the connector 61C and a second C-shaped curved portion 81B that is continuous with the first C-shaped curved portion 81A. The first C-shaped curved portion 81A and the second C-shaped curved portion 81B are curved so as to protrude in mutually opposite directions. The first C-shaped curved portion 81A is curved so as to protrude leftwardly in a plan view and so as to protrude downwardly in a lateral view (see also FIG. 6 and FIG. 9). The second C-shaped curved portion 81B is curved so as to protrude rightwardly and forwardly in a plan view. An S-shaped curved portion 82 is provided at the first drawn portion 61A by the first C-shaped curved portion 81A and the second C-shaped curved portion 81B. The S-shaped curved portion 82 of the first drawn portion 61A is bent so as to have the shape of the letter S at least in a plan view.

Figure 14:
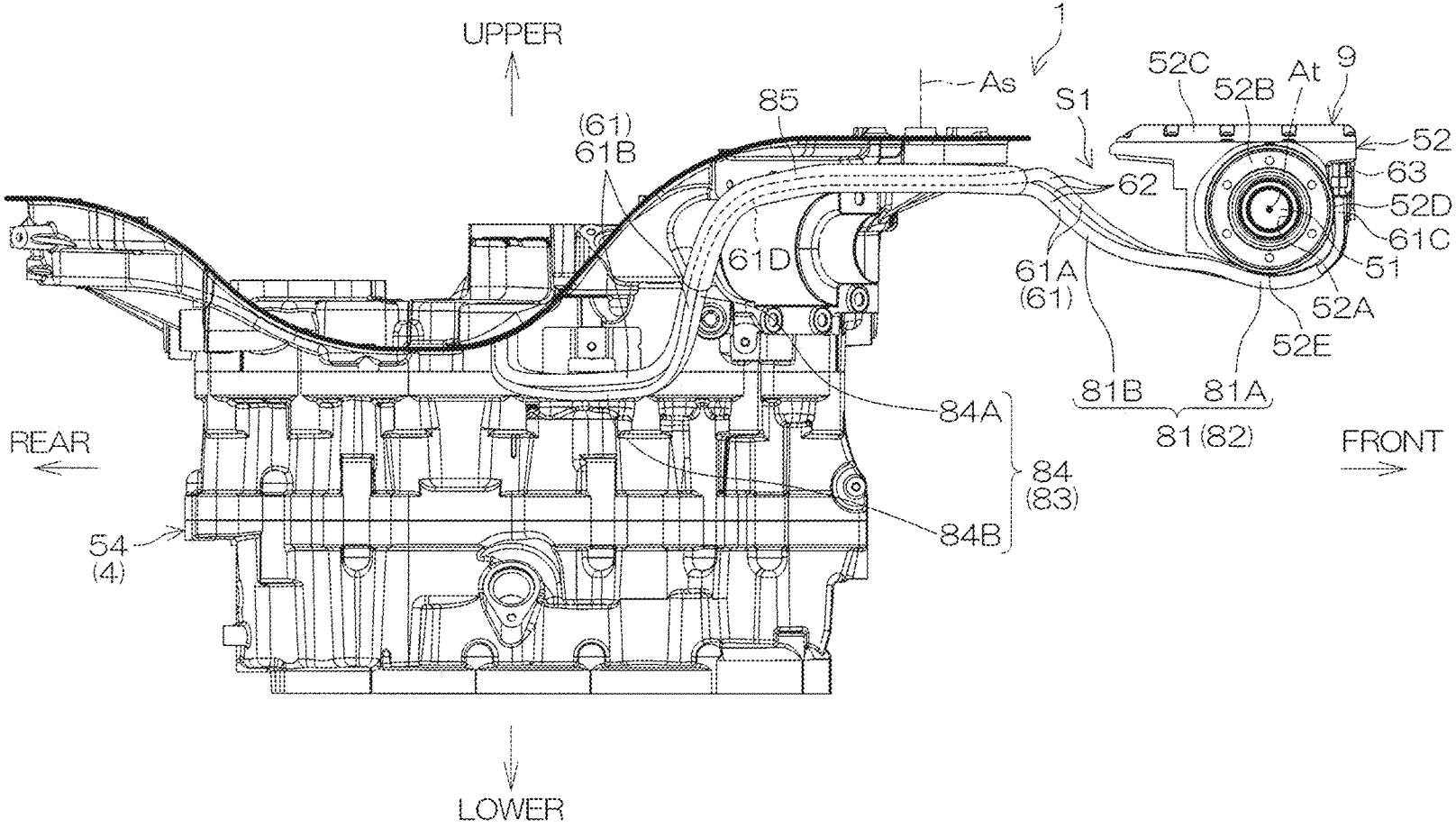
FIG. 14 is a right side view of the outboard motor body, the electric steering actuator, and the harness when the outboard motor body is in the original position.

FIG. 14 is a right side view of the outboard motor body 4, the electric steering actuator 9, and the harness 61 when the outboard motor body 4 is in the original position. The second drawn portion 61B of the harness 61 has an S-shaped curved portion 83 bent so as to have the shape of the letter S in the same way as the S-shaped curved portion 82. A plurality of C-shaped curved portions 84 (in the present preferred embodiment, two C-shaped curved portions 84) defining the S-shaped curved portion 83 of the second drawn portion 61B includes a third C-shaped curved portion 84A closest to the first drawn portion 61A and a fourth C-shaped curved portion 84B that is continuous with the third C-shaped curved portion 84A. The third C-shaped curved portion 84A may include a portion of the halfway portion 61D housed in the duct 73 (not shown in FIG. 14). The third C-shaped curved portion 84A is bent so as to protrude upwardly in a right side view, and the fourth C-shaped curved portion 84B is bent so as to protrude downwardly in a right side view. Therefore, the S-shaped curved portion 83 of the second drawn portion 61B is bent so as to have the shape of the letter S at least in a right side view.

Figure 15:
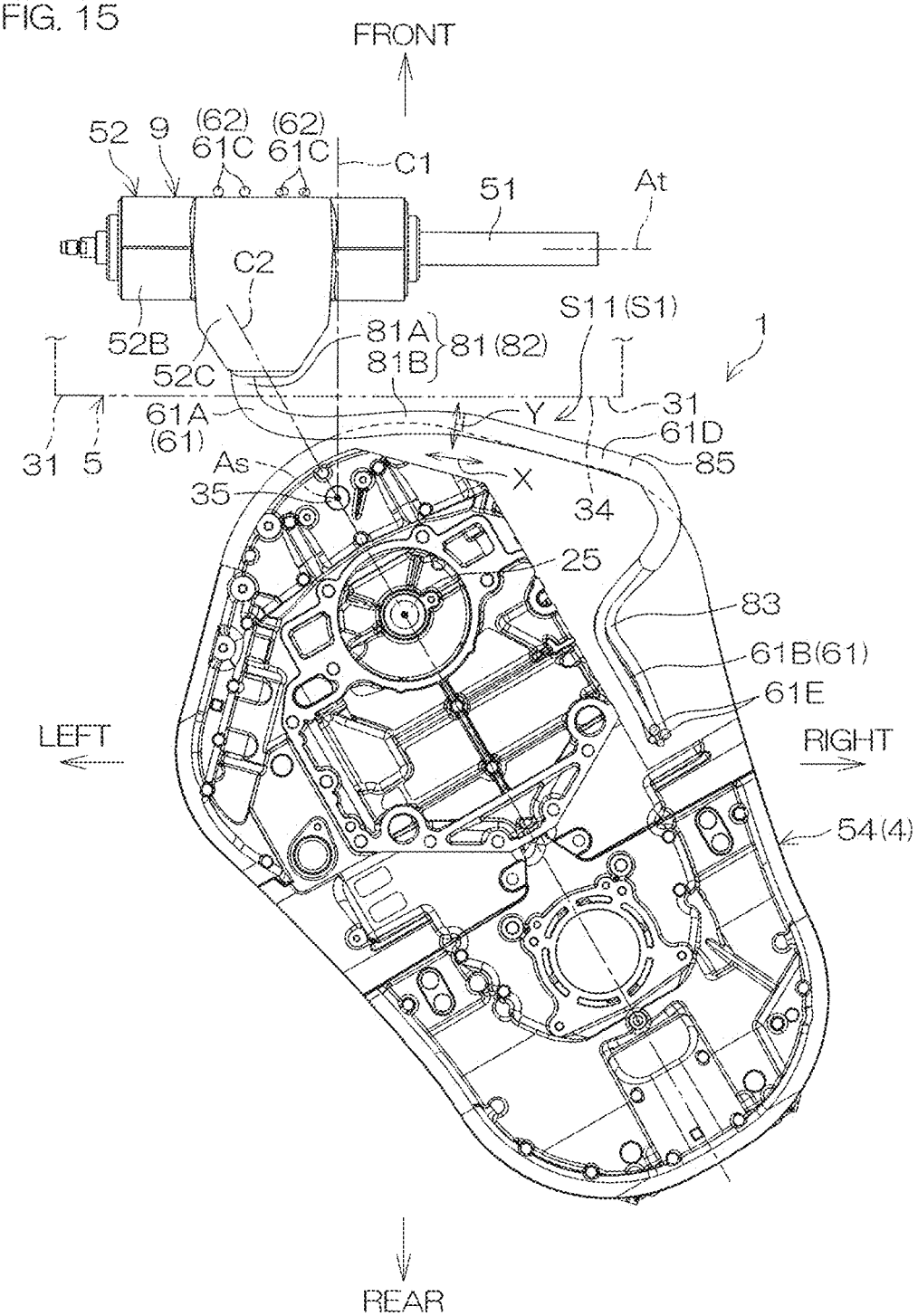
FIG. 15 is a plan view of the outboard motor body, the electric steering actuator, and the harness when the outboard motor body is in a rightward maximum steering position.
Figure 16:
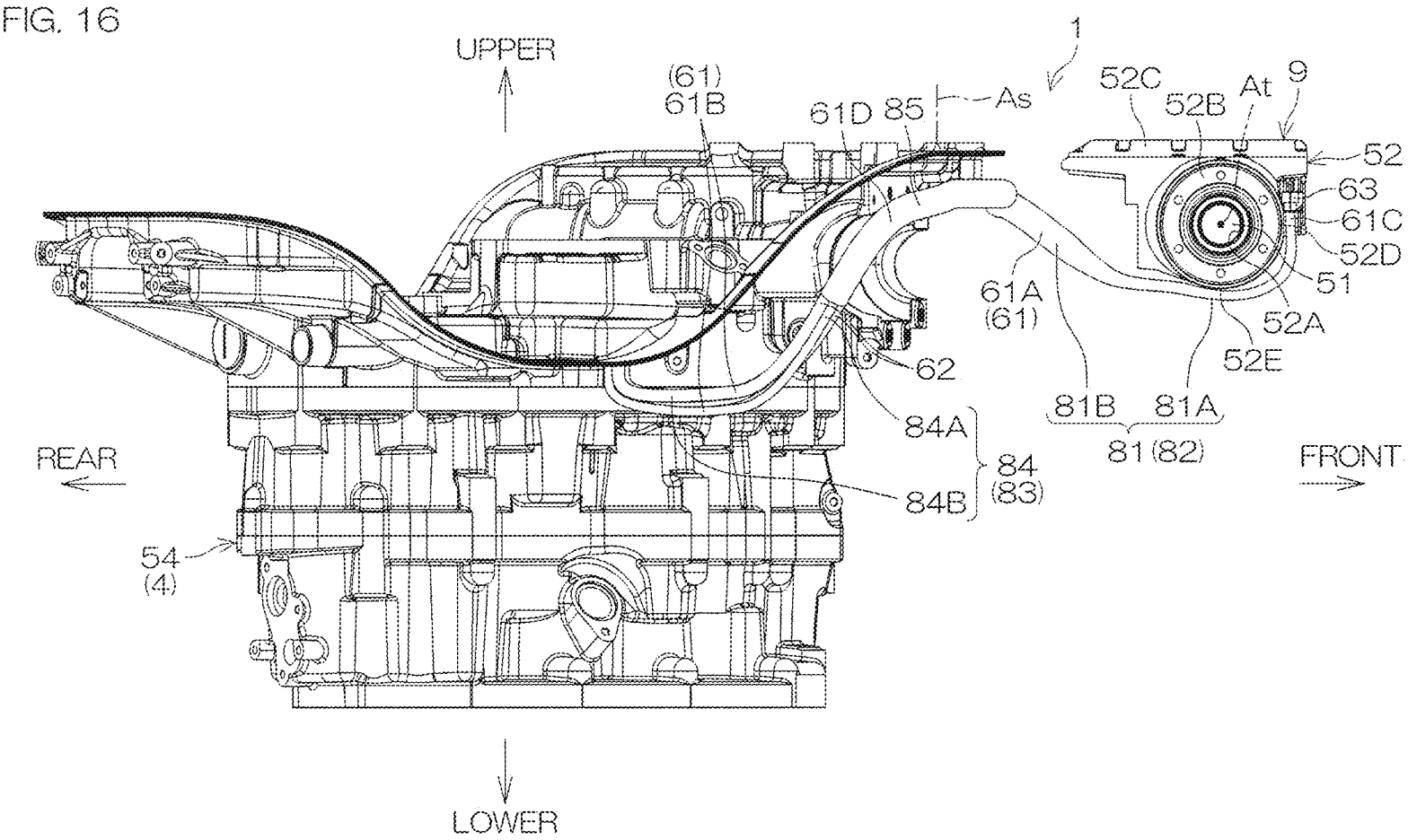
FIG. 16 is a right side view of the outboard motor body, the electric steering actuator, and the harness when the outboard motor body is in the rightward maximum steering position.

FIG. 15 and FIG. 16 are a plan view and a right side view, respectively, of the outboard motor body 4, the electric steering actuator 9, and the harness 61 when the outboard motor body 4 is in the rightward maximum steering position. When the movable body 52 of the electric steering actuator 9 maximally moves leftwardly from the neutral position to the left limit position, the outboard motor body 4 turns rightwardly to the rightward maximum steering position. At this time, the harness 61 located on the right side of the outboard motor body 4 is stretched by being extended leftwardly by the movable body 52. More specifically, the first drawn portion 61A is stretched, and the halfway portion 61D in the duct 73 is extended leftwardly and forwardly by the first drawn portion 61A, and, as a result, the second drawn portion 61B is stretched leftwardly and forwardly.

When the outboard motor body 4 turns rightwardly in this way, both the first drawn portion 61A and the second drawn portion 61B are stretched while providing separate roles, and therefore it is possible to prevent either the first drawn portion 61A or the second drawn portion 61B from being fully stretched.

Even if the movable body 52 is located at any position between the neutral position and the left limit position, the first drawn portion 61A extends and crosses the center C1 in the right-left direction (see FIG. 15). Additionally, a left end of the main portion 52B of the movable body 52 in the left limit position is able to enter the inside of the left tilt shaft 32 (see FIG. 11).

Figure 17:
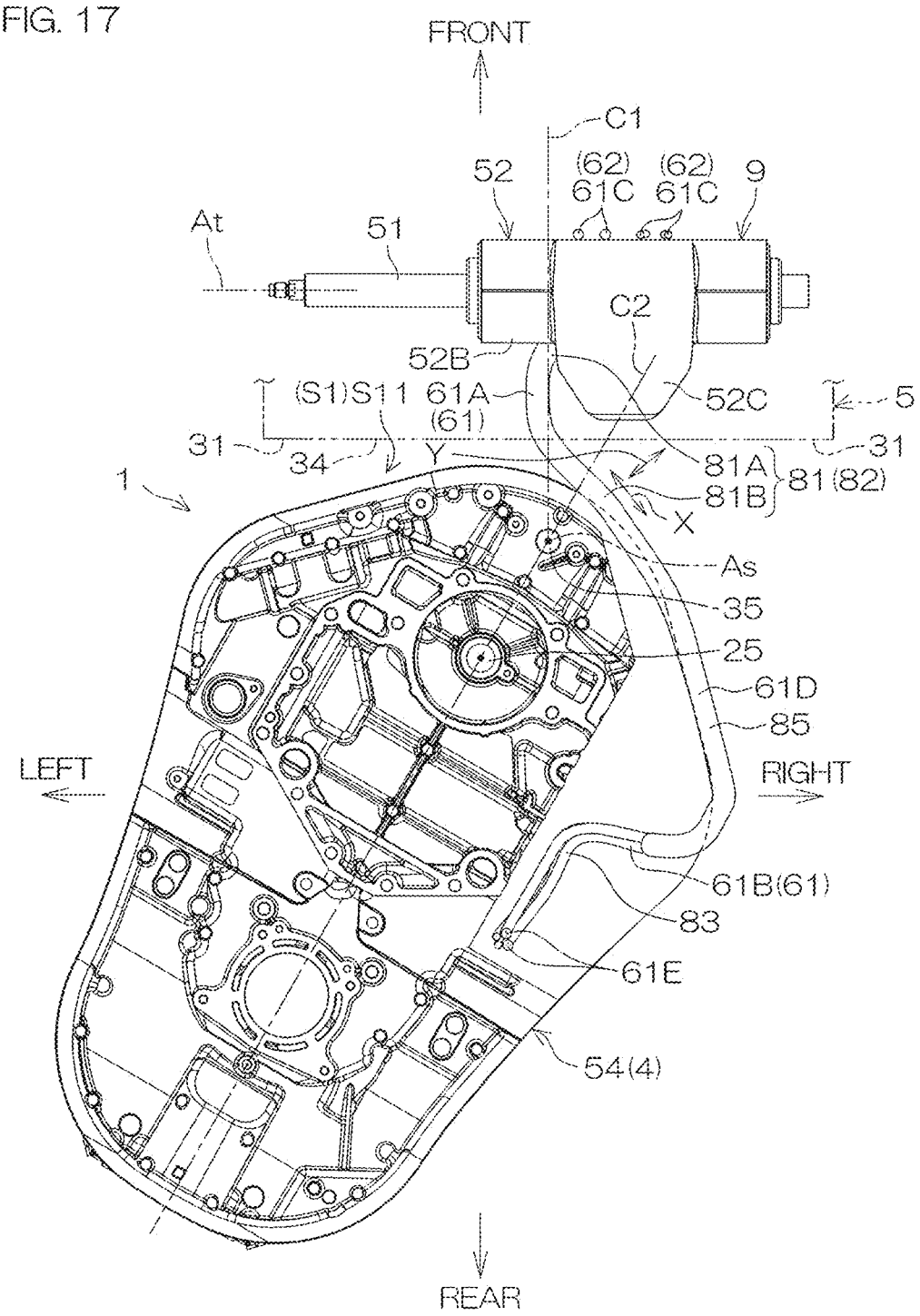
FIG. 17 is a plan view of the outboard motor body, the electric steering actuator, and the harness when the outboard motor body is in a leftward maximum steering position.
Figure 18:
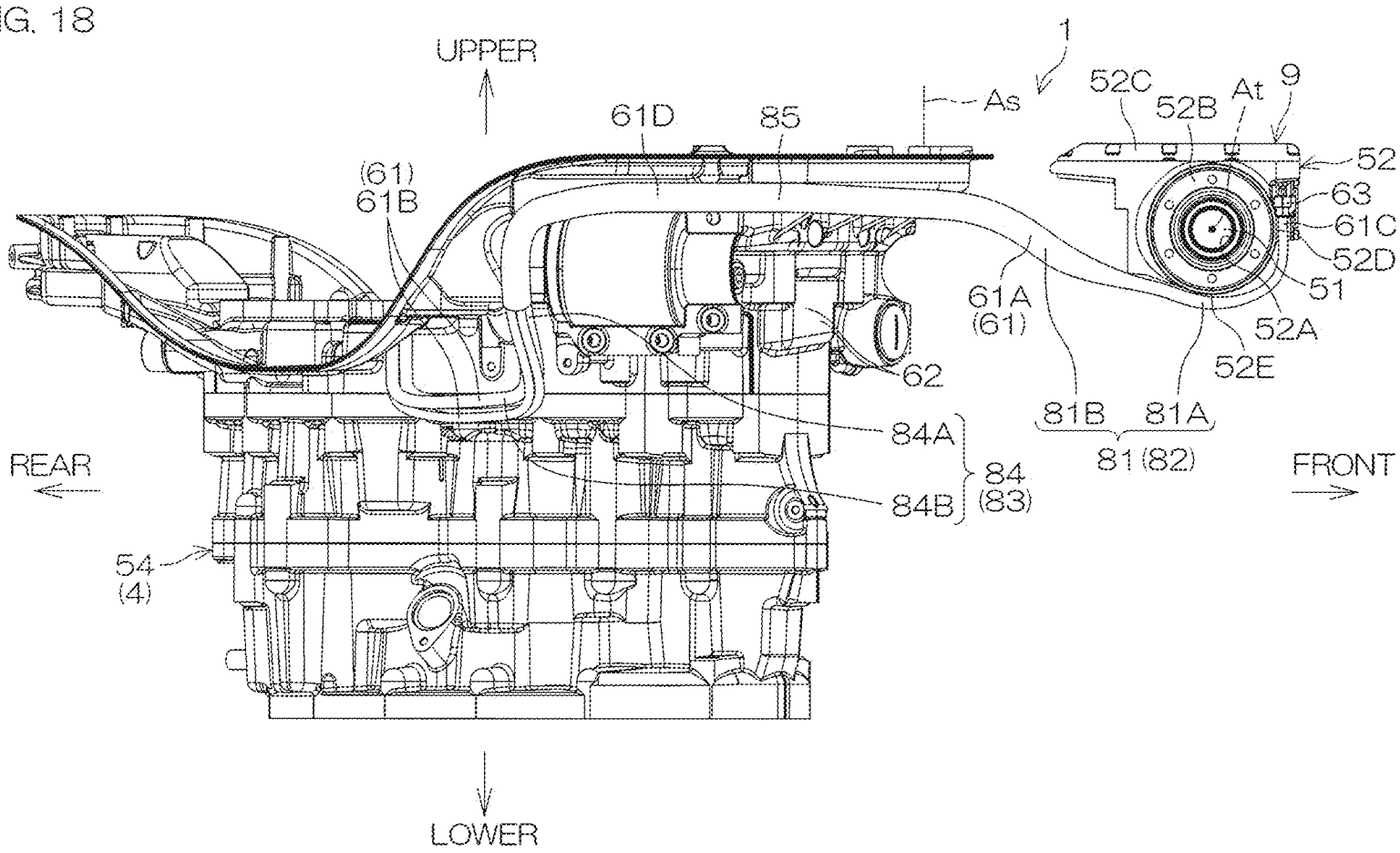
FIG. 18 is a right side view of the outboard motor body, the electric steering actuator, and the harness when the outboard motor body is in the leftward maximum steering position.

FIG. 17 and FIG. 18 are a plan view and a right side view, respectively, of the outboard motor body 4, the electric steering actuator 9, and the harness 61 when the outboard motor body 4 is in the leftward maximum steering position. When the movable body 52 of the electric steering actuator 9 maximally moves rightwardly from the neutral position to the right limit position, the outboard motor body 4 turns leftwardly to the leftward maximum steering position. At this time, the harness 61 located on the right side of the outboard motor body 4 is bent by being pressed by the movable body 52 in such a manner as to shrink back and forth. More specifically, the first drawn portion 61A is pressed rearwardly, and is bent. Thereupon, the halfway portion 61D in the duct 73 is pressed rightwardly and rearwardly, and, accordingly, the second drawn portion 61B is also bent in such a manner as to shrink back and forth.

When the outboard motor body 4 turns leftwardly in this way, both the first drawn portion 61A and the second drawn portion 61B are bent while providing separate roles. In this case, it is possible to prevent the first drawn portion 61A from being entirely bent and being pinched between the outboard motor body 4 and the movable body 52 or the like.

Even if the movable body 52 is located at any position between the neutral position and the right limit position, the first drawn portion 61A extends and crosses the center C1 in the right-left direction (see FIG. 17). Additionally, a right end of the main portion 52B of the movable body 52 in the right limit position is able to enter the inside of the right tilt shaft 32 (see FIG. 11).

As described above with the present preferred embodiment, when the electric steering actuator 9 moves the movable body 52 rightwardly and leftwardly, the steering arm 38 connected to the movable body 52 turns around the steering shaft 35 together with the outboard motor body 4. The harness 61 by which the outboard motor body 4 and the movable body 52 of the electric steering actuator 9 are connected together includes the first drawn portion 61A connected to the movable body 52. The first drawn portion 61A extends around and toward the outboard motor body 4 in the right-left direction, and crosses the center C1 of the swivel bracket 34 in the right-left direction at least in a state in which the movable body 52 is in the neutral position in the right-left direction (see FIG. 13). It is possible for the first drawn portion 61A to stretch or shrink in an oblong space S1 (see FIG. 13) between the outboard motor body 4 and the swivel bracket 34 or the like (i.e., the suspension device 5) and to absorb a difference in the moving path between the outboard motor body 4 and the movable body 52. In that case, the first drawn portion 61A stretches or shrinks so as not to be caught on the outboard motor body 4 being turned or on the movable body 52 rectilinearly moving rightwardly and leftwardly or so as not to be pinched between the outboard motor body 4 and the suspension device 5. This makes it possible to prevent the harness 61 from being damaged.

In a state in which the movable body 52 is not in the neutral position, it is possible that the first drawn portion 61A does not extend in such a way as to cross the center C1 of the swivel bracket 34 in the right-left direction. For example, in a state in which the movable body 52 is in the right limit position, it is possible that the first drawn portion 61A is located at a more rightward position than the center C1 (see FIG. 17). On the other hand, with respect to a center C2 of the outboard motor body 4 in the right-left direction (a line that passes through the steering axis As and the center of the drive shaft 25), the first drawn portion 61A is located so as to cross the center C2 in the right-left direction even if the movable body 52 is at any position (see FIG. 13, FIG. 15, and FIG. 17).

In the present preferred embodiment, the C-shaped curved portion 81 of the first drawn portion 61A is deformed mainly in an approaching-receding direction X in which both ends of the C-shaped curved portion 81 approach each other or recede from each other, and yet is not deformed so much in a direction Y perpendicular to the approaching-receding direction X (as an example, see the second C-shaped curved portion 81B of FIG. 13). In a space S1 between the outboard motor body 4 and the suspension device 5, a region S11 that is narrow in the back and forth direction in accordance with the movement of the outboard motor body 4 and in accordance with the movement of the movable body 52 is a right region of the space S1 when the outboard motor body 4 is steered rightwardly (see FIG. 15). The region S11 used when the outboard motor body 4 is steered leftwardly is a left region of the space S1 (see FIG. 17). The C-shaped curved portion 81 is located so that the region S11 is not located in front of the C-shaped curved portion 81 in the approaching-receding direction X (see FIG. 13), and, as a result, it becomes possible to prevent the C-shaped curved portion 81 from entering the region S11 and from being pinched when the outboard motor body 4 is steered leftwardly or rightwardly. Therefore, it is possible to more reliably prevent the harness 61 from being damaged.

In the present preferred embodiment, in the first drawn portion 61A, the S-shaped curved portion 82 includes the plurality of C-shaped curved portions 81 that are continuous with each other (see FIG. 13). The connectors 81C of the C-shaped curved portions 81 are mainly deformed when the harness 61 stretches or shrinks, and therefore it becomes possible to absorb a difference in the moving path between the outboard motor body 4 and the movable body 52 even if the entire S-shaped curved portion 82 is not deformed so much. This makes it possible to prevent the S-shaped curved portion 82 from being pinched between the outboard motor body 4 and the swivel bracket 34 or the like, or from being worn out by contact of the outboard motor body 4 and the like with surrounding members, and therefore it is possible to more reliably prevent the harness 61 from being damaged.

In the present preferred embodiment, the first drawn portion 61A, which is connected to the front surface 52D of the movable body 52 and extends under the lower surface 52E of the movable body 52 and around behind the movable body 52, is positioned in the right-left direction by the first positioner (see FIG. 8). Therefore, it is possible to prevent the first drawn portion 61A from being cut off or being worn out, which is caused by the first drawn portion 61A moving rightwardly and leftwardly and rubbing against the lower surface 52E of the movable body 52 and the like. Additionally, it is possible to prevent the first drawn portion 61A from drooping during movement of the movable body 52 and coming into contact with an inner bottom surface 34D of the swivel bracket 34 (see FIG. 6). This makes it possible to more reliably prevent the harness 61 from being damaged.

In the present preferred embodiment, the connector 61C connected to the front surface 52D of the movable body 52 in the first drawn portion 61A is located at a position higher than the first positioner 71 (see FIG. 6). This makes it possible to lengthen a portion from the first positioner 71 to the connector 61C in the first drawn portion 61A, and therefore it is possible to effectively absorb a difference in the moving path between the outboard motor body 4 and the movable body 52 by stretching or shrinking this portion. Additionally, it is possible to prevent the connector 61C from becoming wet when the inside of the swivel bracket 34 is submerged.

In the present preferred embodiment, the steering arm 38 extends upwardly and is connected to the movable body 52, and therefore a space S2 to locate a portion of the harness 61 is secured below the steering arm 38 (see FIG. 4). This makes it possible to prevent the harness 61 from being damaged because the portion of the harness 61 is not caught on the outboard motor body 4 or the like.

In the present preferred embodiment, the second positioner 72 fixed to the swivel bracket 34 positions the first drawn portion 61A (see FIG. 11). Hence, the first drawn portion 61A does not come into contact with the steering arm 38, and therefore it is possible to prevent the harness 61 from being damaged.

In the present preferred embodiment, the fastener 64 fixes the connector 61C of the first drawn portion 61A to the front surface 52D of the movable body 52 (see FIG. 6). This makes it possible to prevent the connector 61C from moving and rubbing against surrounding members, such as an inner surface 34E of the swivel bracket 34, and therefore it is possible to prevent the harness 61 from being damaged.

In the present preferred embodiment, the fastener 64 includes the cylindrical portion 65 into which the first drawn portion 61A is inserted, the ring portion 66 integral with the upper end 65A of the cylindrical portion 65, and the cover 68 that sandwiches the ring portion 66 between the front surfaces 52D and the cover 68 (see FIG. 7 and FIG. 8). In the front surface 52D, the ring portion 66 surrounds the connector 61C extending out from the cylindrical portion 65 in the first drawn portion 61A. The fastener 64 makes it possible not only to fix the connector 61C to the front surface 52D but also to seal the connector 61C by the ring portion 66 so as not to become wet. Additionally, as described above, the first drawn portion 61A is positioned by the first positioner 71 in the right-left direction, and therefore the attitude of the fastener 64 is stabilized. This makes it possible to prevent the deformation of the ring portion 66 between the cover 68 of the fastener 64 and the front surface 52D, and therefore it is possible to prevent a decrease in the sealability of the ring portion 66 that is caused by the deformation of the ring portion 66.

In the present preferred embodiment, the halfway portion 61D of the harness 61 is inserted into the duct 73 fixed to the outboard motor body 4 (see FIG. 12). This makes it possible to prevent the harness 61 from being damaged because the halfway portion 61D of the harness 61 is protected so as not to come into contact with members (such as the casing 22) outside the duct 73.

In the present preferred embodiment, the second drawn portion 61B connected to the outboard motor body 4 in the harness 61 includes the S-shaped curved portion 83 (see FIG. 16). Thus, it is possible to prevent the second drawn portion 61B, which includes the S-shaped curved portion 83 that has a small total deformation volume in the same way as the S-shaped curved portion 82 of the first drawn portion 61A, from being pinched or being worn out, and therefore it is possible to more reliably prevent the harness 61 from being damaged.

In the present preferred embodiment, the first drawn portion 61A including the plurality of electric wires 62 arranged in a line in the harness 61 is flat, and therefore it is possible to locate the first drawn portion 61A in a narrow space S3 around the movable body 52 in the swivel bracket 34 so that the first drawn portion 61A does not come into contact with surrounding members (see FIG. 6 and FIG. 10). The plurality of electric wires 62 in the second drawn portion 61B are arranged in a polygonal shape and hence move collectively when the harness 61 stretches or shrinks, and therefore the plurality of electric wires 62 do not come into contact with surrounding members (see FIG. 13). Therefore, it is possible to more reliably prevent the harness 61 from being damaged. The plurality of electric wires 62 may be bundled together by a banding member 85 or the like, such as a tube, so as to maintain a state in which the plurality of electric wires 62 are arranged in a polygonal shape (see FIG. 12). As a result, the harness 61 is protected, and therefore it is possible to reduce the wear of the harness 61 that is caused by, for example, sliding in the duct 73.

In the present preferred embodiment, at least one portion of the second drawn portion 61B is located in a laterally narrow space S4 between the casing 22 and the side surface 7A of the engine 7 (see FIG. 1). The S-shaped curved portion 83 of the second drawn portion 61B has the shape of the letter S in a lateral view (see FIG. 14). The S-shaped curved portion 83 in this case is not easily deformed right and left, and thus does not come into contact with the casing 22 and the engine 7. Therefore, it is possible to more reliably prevent the harness 61 from being damaged.

In the present preferred embodiment, it is possible to connect the steering arm 38 to the movable body 52 disposed in the swivel bracket 34 by inserting the steering arm 38 into the opening 34C of the outer surface 34B of the swivel bracket 34 (see FIG. 5). The inside of the swivel bracket 34 is exposed only by the opening 34C, and therefore it is possible to prevent foreign substances, such as floating wreckage on the sea, from entering the inside of the swivel bracket 34 when the vessel 2 travels rearwardly or brakes suddenly.

Although preferred embodiments of the present invention have been described above, the present invention is not restricted to the contents of these preferred embodiments and various modifications are possible within the scope of the present invention.

The electric steering actuator 9 may be located outside the swivel bracket 34 without being built into the swivel bracket 34. However, the electric steering actuator 9 is required to be located so that the electric steering actuator 9 does not interfere with the transom 3A when the outboard motor body 4 is located in the tilt up position.

In the harness 61, the second drawn portion 61B stretches or bends together with the first drawn portion 61A when the outboard motor body 4 is turned as described above. When an operator performs wiring of the harness 61, the second drawn portion 61B may be deformed only to adjust so that the first drawn portion 61A assumes an optimum shape, and thereafter only the first drawn portion 61A may stretch or bend when the outboard motor body 4 is turned.

The harness 61 may be extended around leftwardly from the engine 7 without extending around rightwardly from the engine 7 as in the above described preferred embodiments.

The harness 61 may include only one electric wire 62.

The first drawn portion 61A and the second drawn portion 61B of the harness 61 may include only the C-shaped curved portions without defining S-shaped curved portions.

Also, features of two or more of the various preferred embodiments described above may be combined.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An outboard motor comprising:

a clamp bracket attached to a hull;

a tilt shaft that extends rightwardly and leftwardly and is connected to the clamp bracket;

a swivel bracket connected to the tilt shaft and that is turnable around the tilt shaft with respect to the clamp bracket;

a steering shaft supported by the swivel bracket and that extends upwardly and downwardly;

an outboard motor body including a propeller and that is turnable around the steering shaft;

a steering arm that extends farther forward than the steering shaft and that is turnable around the steering shaft together with the outboard motor body;

an electric steering actuator located at a more forward position than the steering shaft and including a movable body that is connected to the steering arm, the electric actuator being fixed to the swivel bracket and that moves the movable body rightwardly and leftwardly; and a flexible harness that includes a first drawn portion and that electrically connects the outboard motor body and the electric steering actuator together, the first drawn portion being connected to the movable body and extending around and toward the outboard motor body in a right-left direction, and crossing a center of the swivel bracket in the right-left direction at least in a state in which the movable body is in a neutral position in the right-left direction.

2. The outboard motor according to claim 1, wherein the first drawn portion includes a C-shaped curved portion that is bent in a C shape.

3. The outboard motor according to claim 2, wherein the first drawn portion includes an S-shaped curved portion that includes a plurality of the C-shaped curved portions that are continuous with each other.

4. The outboard motor according to claim 1, further comprising a first positioner fixed to a lower surface of the movable body and that positions the first drawn portion in the right-left direction; wherein the first drawn portion is connected to a front surface of the movable body and extends around and behind the movable body while extending under the lower surface of the movable body.

5. The outboard motor according to claim 4, wherein the first drawn portion includes a connector connected to the front surface of the movable body and is located at a position higher than the first positioner.

6. The outboard motor according to claim 5, wherein the steering arm includes a front end connected to the movable body at a position higher than the lower surface of the movable body, and a rear end connected to the steering shaft; and the front end is located at a position higher than the rear end.

7. The outboard motor according to claim 5, further comprising a second positioner fixed to the swivel bracket and that positions the first drawn portion so as not to come into contact with the steering arm.

8. The outboard motor according to claim 5, further comprising a fastener that fixes the connector to the front surface of the movable body.

9. The outboard motor according to claim 8, wherein the fastener includes:

a cylindrical portion into which the first drawn portion is inserted;

a ring portion integral with an end of the cylindrical portion and that surrounds the connector of the first drawn portion extending from the cylindrical portion at the front surface; and a cover that sandwiches the ring portion between the front surface and the cover.

10. The outboard motor according to claim 1, further comprising a duct fixed to the outboard motor body; wherein a portion of the harness is located in the duct.

11. The outboard motor according to claim 1, wherein the harness includes a second drawn portion including an S-shaped curved portion that is bent in an S shape and that is connected to the outboard motor body.

12. The outboard motor according to claim 11, wherein the harness includes a plurality of electric wires bundled together; and the plurality of electric wires extend in a line along a surface of the movable body in the first drawn portion, and are arranged in a polygonal shape in the second drawn portion.

13. The outboard motor according to claim 11, wherein the outboard motor body includes a casing that is hollow and an engine located in the casing and that generates a driving force by which the propeller is rotated; and at least a portion of the second drawn portion is located between the casing and a side surface of the engine.

14. The outboard motor according to claim 1, wherein the swivel bracket houses the movable body; and the swivel bracket includes an opening into which the steering arm is inserted.

* * * * *